US005587548A

United States Patent [19]

Smith, III

[11] Patent Number: 5,587,548

[45] Date of Patent: Dec. 24, 1996

[54] MUSICAL TONE SYNTHESIS SYSTEM HAVING SHORTENED EXCITATION TABLE

[75] Inventor: Julius O. Smith, III, Palo Alto, Calif.

[73] Assignee: The Board of Trustees of the Leland Stanford Junior University, Palo Alto, Calif.

[21] Appl. No.: 300,497

[22] Filed: Sep. 1, 1994

Related U.S. Application Data

[63] Continuation-in-part of Ser. No. 90,783, Jul. 13, 1993, Pat. No. 5,500,486.

[51] Int. Cl.[6] ..... G10H 5/02

[52] U.S. Cl. ..... 84/659; 84/622; 84/661

[58] Field of Search ..... 84/622, 626, 630, 84/659, 660, 661, 663

[56] References Cited

U.S. PATENT DOCUMENTS

| | | | |
|---|---|---|---|
| 4,108,036 | 8/1978 | Slaymaker | 84/1.01 |
| 5,187,313 | 2/1993 | Inoue | 84/661 X |
| 5,192,825 | 3/1993 | Kunimoto | 84/661 |
| 5,223,656 | 6/1993 | Higashi | 84/661 |
| 5,286,914 | 2/1994 | Kunimoto | 84/660 X |
| 5,359,146 | 10/1994 | Funaki et al. | 84/661 X |
| 5,373,098 | 12/1994 | Kitayama et al. | 84/659 |
| 5,403,969 | 4/1995 | Muto | 84/622 |
| 5,408,042 | 4/1995 | Masuda | 84/661 |
| 5,451,707 | 9/1995 | Suzuki | 84/622 X |

*Primary Examiner*—William M. Shoop, Jr.
*Assistant Examiner*—Jeffrey W. Donels
*Attorney, Agent, or Firm*—Graham & James LLP

[57] ABSTRACT

A tone synthesis system employs a filtered delay loop which is excited by an excitation signal. The excitation signal corresponds to a partial impulse response of a body filter to the system which is to be simulated. Additional components of the impulse response of the body filter are imparted to an output from the filtered delay loop. High quality tone synthesis can be achieved without the necessity of providing a complicated body filter.

46 Claims, 15 Drawing Sheets

TRUE COUPLING SIMULATION FOR THE TWO-STRING CASE

MUSICAL TONE SYNTHESIS SYSTEM HAVING SHORTENED EXCITATION TABLE

RELATED APPLICATION

This application is a continuation-in-part of U.S. Ser. No. 08/090,783 filed Jul. 13, 1993, now U.S. Pat. No. 5,500,486, which application is incorporated herein by reference.

BACKGROUND OF THE INVENTION

1. Field of the Invention

The present invention relates to musical tone synthesis techniques. More particularly, the present invention relates to what is known as "physical-modeling synthesis" in which tones are synthesized in accordance with the mechanisms which occur in natural musical instruments. Music synthesis based on a physical model is gaining on currently dominant methods such as "sampling" (or "wave table") synthesis and frequency modulation (FM) synthesis. Such synthesis techniques are particularly useful for simulation of wind instruments and string instruments. By accurately simulating the physical phenomena of sound production in a natural musical instrument, an electronic musical instrument is capable of providing high quality tones.

2. Description of Related Art

In the case of a string instrument, the structure for synthesizing tones typically includes a filtered delay loop, i.e., a closed loop which includes a delay having a length corresponding to one period of the tone to be generated and a filter contained in a closed loop. An excitation signal is introduced into the closed loop and circulates in the loop. A signal may be extracted from the loop as a tone signal. The signal will decay in accordance with the filter characteristics. The filter models losses in the string and possibly at the string termination (e.g., nut and bridge in a guitar).

In an actual stringed instrument, the string is coupled to a resonant body and the vibration of the string excites the resonant body. In order to accurately model a natural musical instrument, therefore, it has been necessary to provide a filter at the output of the filtered delay loop. To obtain high quality sound, it has been necessary to follow the string output by a large and expensive filter which simulates the musical instrument body. The excitation signal generally takes the form of white noise or filtered white noise. Alternatively, a physically accurate "pluck" waveform may be provided as an excitation to the closed loop, which results in more accurate plucked string simulation.

A tone synthesis system as described above is illustrated in FIG. 1. A filtered delay loop is formed of a delay element 10 and a low pass filter 12. An excitation source (e.g., a table) 14 provides an excitation signal into the loop via an adder 16. The contents of the excitation table may be automatically read out of a memory table in response to a trigger signal generated in response to, e.g., depression of a key. The excitation signal which is inserted into the filtered delay loop circulates and changes over time due to the filter operation. A signal is extracted from the delay loop and provided to a body filter 18. For high quality instrument synthesis, a complicated and expensive body filter (typically a digital filter) or additional filtered delay loop is required.

The tone synthesis system illustrated in FIG. 1 may be implemented in hardware, although it is somewhat more common to implement the tone generation technique in software utilizing one or more digital signal processing (DSP) chips. The system of FIG. 1 is capable of very high quality tone synthesis. However, it has the drawback of requiring a complex and expensive filter which simulates the instrument body.

SUMMARY OF THE INVENTION

The present invention provides a physical model tone synthesis system in which high quality tones can be synthesized without the necessity of an expensive body filter. The body filter can be entirely eliminated and yet tone quality approaching that of a system including a complex body filter can be obtained. The filtered delay loop and body filter are both linear, time-invariant systems. These systems therefore commute, i.e., the body filter can be located before the filtered delay loop to produce an equivalent system. The output of the excitation generator in such a configuration is coupled directly to the body filter. By recognizing that in a plucked or struck string situation the excitation is generally in the form of an impulse, it was determined that the output of the body filter, and thus the excitation applied to the delay loop, will represent the impulse response of the body filter. In the present invention, this impulse response is determined and it is this response which is stored as an aggregate excitation signal. The body filter is thus eliminated, and the aggregate excitation signal is provided directly to the filtered delay loop. Thus, by providing an appropriate excitation signal which corresponds to the body filter impulse response, a high quality sound can be synthesized without requiring an expensive filter.

In an alternative embodiment of the present invention, it is possible to reduce the size of the table required to store the aggregate excitation signals, while still eliminating the complex and costly body filters of the prior art. By factoring a resonator into damped and ringy modes, and only using the impulse response of the damped modes to determine the aggregate excitation, the size of the excitation table can be reduced, thus reducing the size of the memory required to accommodate the aggregate excitation.

The excitation generator may be implemented as a single fixed excitation signal or, alternatively, as a plurality of excitations which are combined to form a composite excitation. By controllably weighting each of the plural different excitations, numerous different composite excitations can be provided. In addition, the various excitations can be controlled to vary over time, thus providing significant control capabilities and tone variation despite the use of a fixed set of excitation signals.

BRIEF DESCRIPTION OF THE DRAWINGS

The invention will be described with reference to the accompanying drawings, wherein.

DESCRIPTION OF THE PREFERRED EMBODIMENT

The following is a description of the best presently contemplated mode of carrying out the invention. The description is not to be taken in a limiting sense but is made for the purpose of illustrating the general principles of the invention. It is particularly noted that the invention may be implemented in either hardware form including various delays, filters, etc. or in software form employing appropriate algorithms implemented, e.g., in a DSP.

Figure 1:
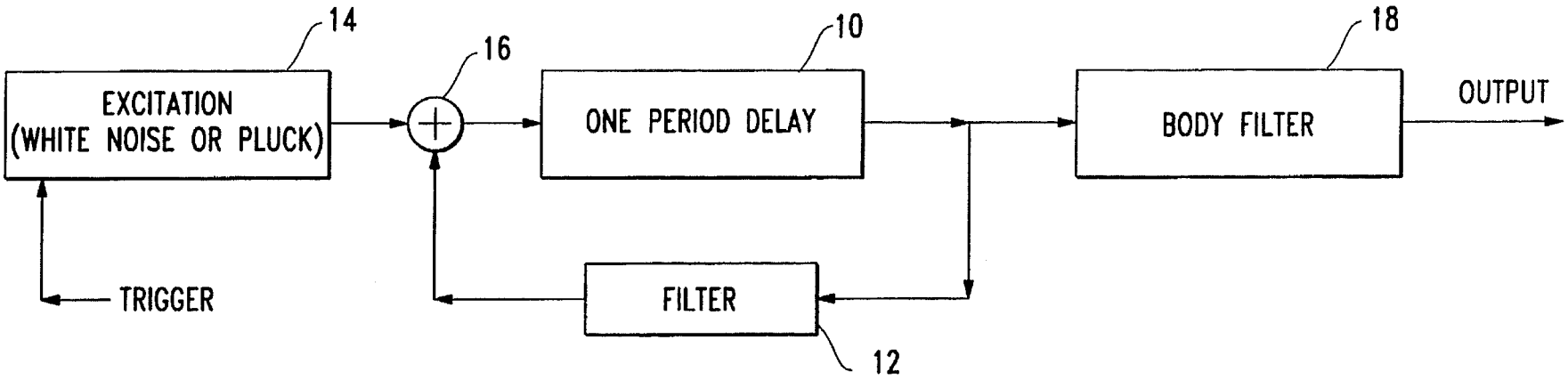
FIG. 1 PRIOR ART
FIG. 1 is a block diagram of a prior art filtered delay loop tone synthesis system employing a body filter.
Figure 2:
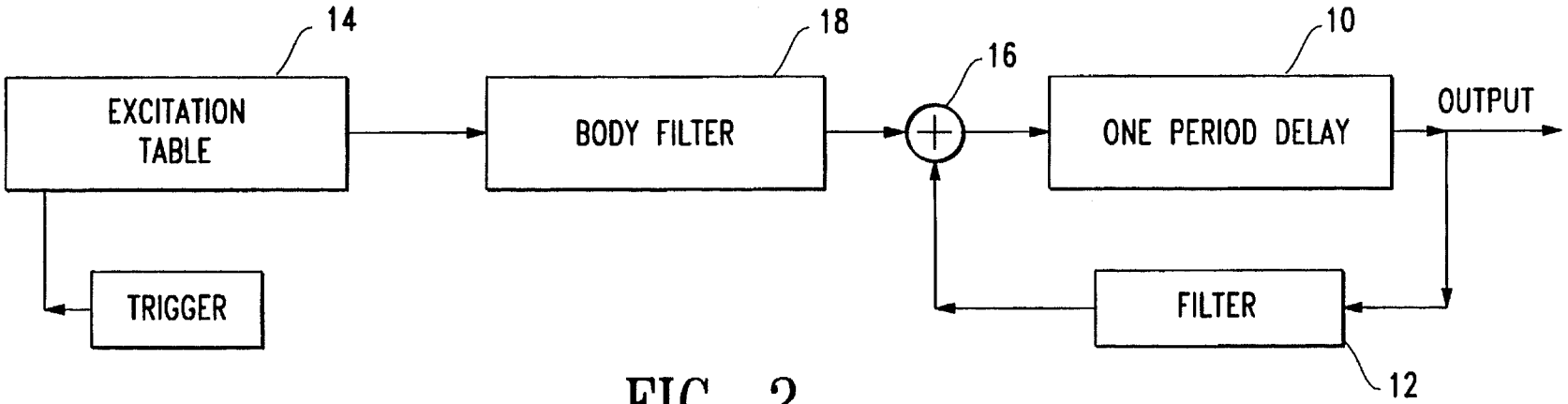
FIG. 2 is a block diagram of a tone synthesis system in which the filtered delay loop and body filter have been commuted.

FIG. 1 illustrates a prior art filtered delay loop tone generation system incorporating a filtered delay section including a delay 10 and filter 12, and a digital filter 18 to simulate the resonating body of a natural musical instrument such as a guitar. An excitation source 14 provides an excitation signal into the delay loop. The inventor has recognized that the filtered delay loop and the body filter are essentially both linear, time-invariant systems. Because of this, the systems commute, i.e., their order can be reversed without altering the resultant tone. This is illustrated in FIG. 2, where the body filter 18 is shown ahead of the filtered delay loop. This modification in and of itself does not provide any significant advantage, since the overall processing requirements remain the same. However, if the string simulation variable is chosen to be transverse acceleration waves, an ideal string pluck becomes an impulse, as is shown in the art. In this case, the output of the excitation table to pluck the string is a single non-zero sample for each pluck, preceded and followed by zeros, i.e., an impulse. As a result, what excites the filtered delay loop is the impulse response of the body filter. Since the body filter does not change over the course of a note, the body impulse response is fixed. The present invention takes advantage of this fact to completely eliminate the need for a body filter. Instead of providing an impulse and passing it through a body filter, an excitation table is loaded with an aggregate excitation representing the impulse response of a desired body filter. The very expensive body filter (or filter processing in a DSP system) which is otherwise needed to simulate connection of the string to a resonating instrument body or other coupled structure can thus be eliminated.

Figure 3:
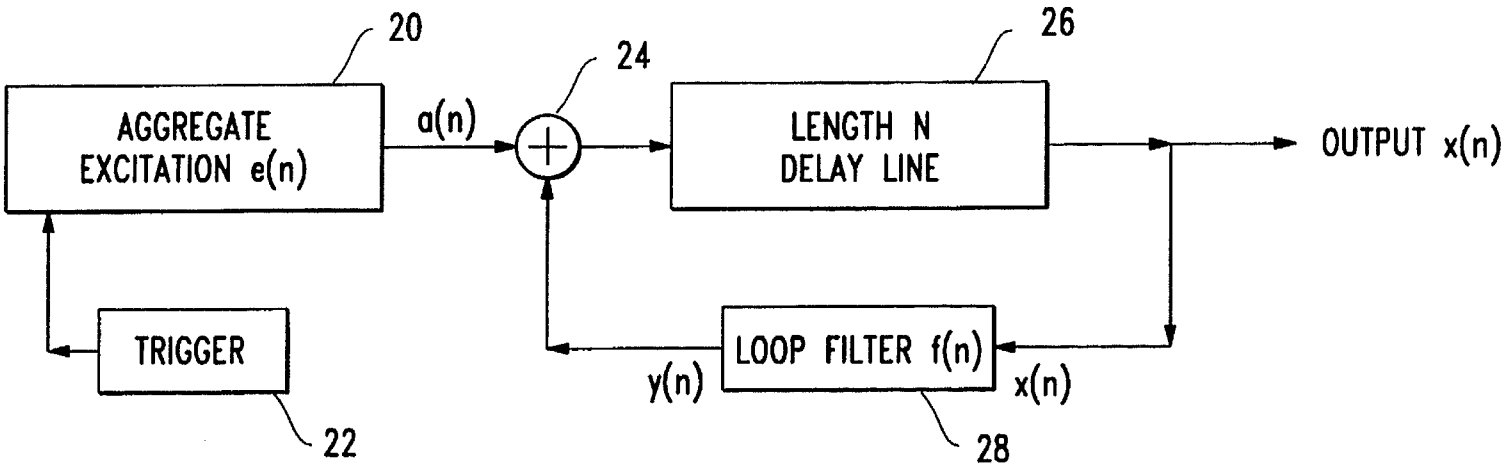
FIG. 3 is a block diagram of the present invention in which an aggregate excitation signal corresponding to the impulse response of the body filter is provided.

FIG. 3 illustrates the configuration of the tone synthesis of the present invention. The system includes an excitation source which in the embodiment shown is a table 20 which provides an aggregate excitation e(n) in response to a trigger (e.g., key-on) signal 22. The aggregate excitation signal is provided to a filtered delay loop via adder 24. The delay loop includes a variable length delay line 26 and a loop filter 28. The output of the delay line 26 is extracted as a tone synthesis output x(n) and is also provided back to the loop filter 28 (multiple outputs may be extracted as is known in the art). The output of the loop filter 28 y(n) is fed back to the adder 24. The length N of the delay line provides a coarse pitch control. The loop filter 28 provides fine pitch control and determines the change in tone throughout the course of a played note. This filter is normally fixed for the duration of a note, but it may also be varied during note to produce effects such as damping by the player's hand, two-stage amplitude-envelope decay (e.g., for piano tones), the beating in the amplitude envelope due to coupling with other strings, pseudo-reverberation in which a small decaying amplitude envelope persists after the nominal cut-off time of the note, and other time varying effects. The excitation signal determines the initial spectral content of the tone, including details attributable to a body filter as well as the physical excitation, such as where a pick was located in the case of a plucked guitar simulation.

The loop filter impulse response (IR), expressed as f(n), n equals 0, 1, 2, . . . , Nf−1 is determined by the losses in the vibrating string associated with bending and air drag, and the losses due to coupling of the string to the instrument body. Determination of the specific loop filter characteristics is known and will not be discussed in detail. The impulse response f(n) may be obtained from equations of basic physics relating to theoretical losses in the string and body coupling. The string material, string tension and diameter may be employed to obtain theoretical predictions of string loss per unit length. Losses at body coupling points, e.g., a guitar bridge, may be predicted from bridge geometry and instrument body resonances. Alternatively, f(n) may be obtained from physical measurements on an actual instrument string. Combinations of predictions based upon equations and actual physical measurements may also be employed.

Figure 4:
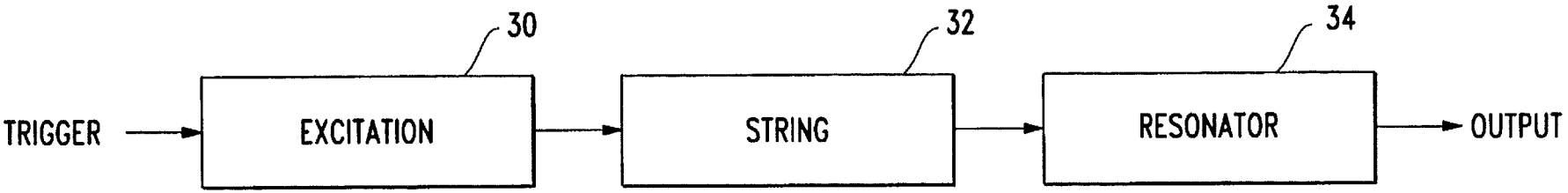
FIG. 4 is a block diagram of the sound generation mechanism of a guitar.
Figure 5:
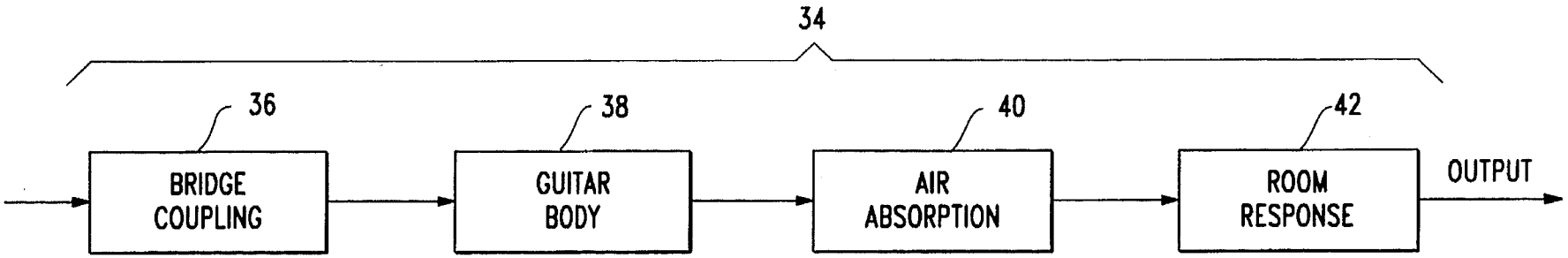
FIG. 5 is a block diagram of the sound generation of a guitar and surrounding space.
Figure 6:
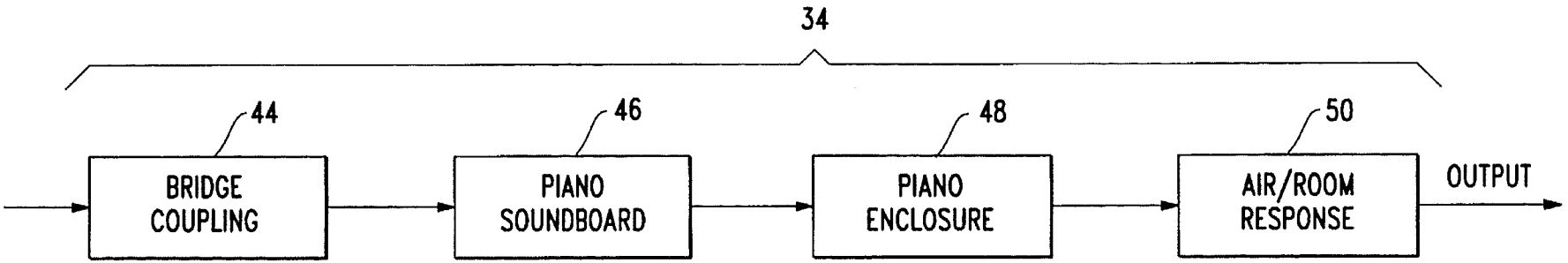
FIG. 6 is a block diagram of the sound generation mechanism of a piano including the surrounding space.

A number of different methods may be employed to determine the excitation signal e(n). The excitation signal e(n) is determined by both the nature of the physical string excitation and the response of the instrument to the point of excitation by the string. In the case of a guitar, the excitation to the body occurs at the bridge of the guitar. FIG. 4 illustrates a physical block diagram of a guitar, including an excitation 30 applied to a string 32 which in turn excites a resonator (the guitar body) 34. In a physical system, a resonator is determined by the choice of output signal. A typical example would be to choose the output signal at a point a few feet away from the top plate of a guitar body. In practice, such a signal can be measured using a microphone held at a desired output point and recording the response at that point to the striking of the guitar bridge with a force hammer. It should be noted that the resonator as defined includes the transmission characteristics of air as well as the resonance characteristics of the guitar body itself. If the output point is chosen far from the guitar in a reverberant room, it will also include resonance characteristics of the room in which the measurement is taken. This aggregate nature of the resonator is depicted in FIG. 5. The overall resonator 34 includes the bridge coupling 36, guitar body 38, air absorption 40 and room response 42. In general, it is desirable to choose the output relatively close to the guitar so as to keep the resonator impulse response as short as possible. However, the generality afforded by being able to combine all downstream filtering into a single resonator is an important feature of the invention. This is more obvious in the case of piano modeling, in which both the sound board and the piano enclosure may be combined in one resonator. This is illustrated in FIG. 6. The overall resonator 34 is formed of a bridge coupling 44, piano sound board 46, piano enclosure 48 and air/room response 50.

Figure 7:
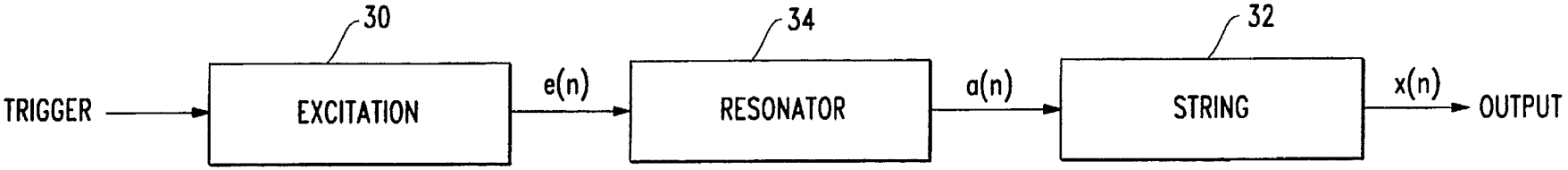
FIG. 7 is a block diagram of a sound generator illustrating an equivalent sound generator mechanism in which a resonator is placed before the string.

The only technical requirement on the components of the resonator is that they be linear and time-invariant. As discussed above, these two properties imply that they are commutative, i.e., they may be implemented in any order. In the case where the string is also linear and time-invariant, the resonator and the string may be commuted as illustrated in FIG. 7. The string is actually the least linear element of almost any stringed musical instrument; however, it is very close to linear, with the main effect of non-linearity being a slight increase of the fundamental vibration frequency with amplitude. For commuting purposes, the string can be considered sufficiently close to linear. The string is also time varying in the presence of vibrato, but this too is a second order effect. While the result of commuting a slowly time-varying string and resonator is not identical mathematically, it will sound essentially the same.

Figure 8:
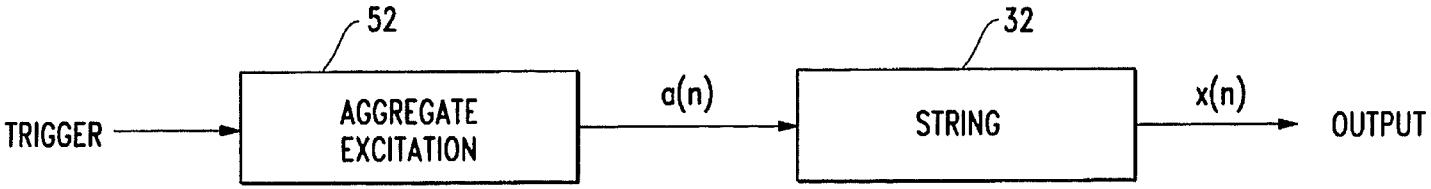
FIG. 8 is a block diagram illustrating the sound generation mechanism in which the response of the resonator to a particular excitation is employed as an aggregate excitation.

Following commutation of the string and resonator as illustrated in FIG. 7, the next step is to combine the excitation and resonator into an aggregate excitation as illustrated in FIG. 8. The aggregate excitation 52 is determined to provide an output a(n) which is essentially the same as the output of the resonator 34 in FIG. 7. First, the nature of the excitation must be specified. The simplest example is an impulse signal. Physically, this would be the most appropriate choice when the string is used to model acceleration waves. In this case, an ideal pluck gives rise to an impulse of acceleration input to the string. In this simple case, the aggregate excitation 52 is simply the sampled impulse response of a chosen resonator. In more elaborate cases, given any excitation signal e(n) and resonator impulse response r(n), the equivalent aggregate excitation signal a(n) is given by the convolution of e(n) and r(n), set forth in Equation (1) below:

$$a(n) = (e*r)(n) = \sum_{m=0}^{n} e(m)r(n-m) \tag{1}$$

If the aggregate excitation is long, it may be desirable to shorten it by some technique. To accomplish this, it is useful to first convert the signal a(n) to minimum phase as described in various references on signal processing. This will provide the maximum shortening consistent with the original magnitude spectrum. Secondly, a(n) can be windowed using the right portion of any of various window functions typically used in spectrum analysis. One useful window is the exponential window, since it has the effect of increasing the damping of the resonator in a uniform manner.

Figure 9:
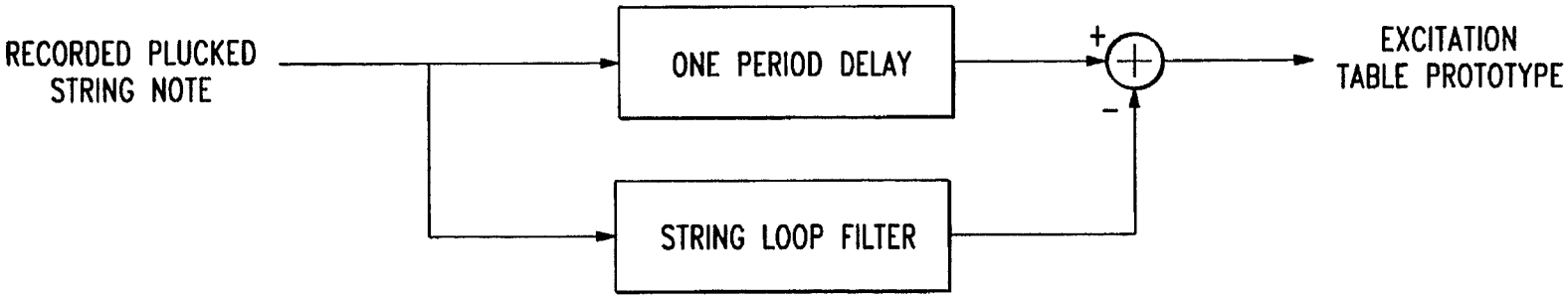
FIG. 9 is a block diagram illustrating an inverse filtering method of determining an excitation signal.

An excitation signal may also be determined by recording a sound from an instrument (e.g., a plucked string sound) and inverse filtering to filter out the contribution of the string loop. This is illustrated in FIG. 9 in which a string loop filter is determined by one of various methods and included in an inverse filter. The resultant output includes components corresponding to the pluck and the body filter, and can be used as an excitation (or as the basis to derive an excitation after modification).

Figure 10:
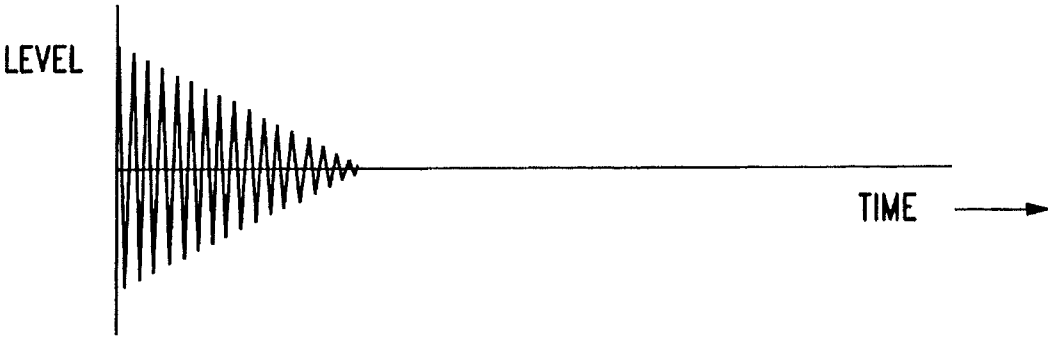
FIG. 10 is an illustration of an example of an excitation signal corresponding to the impulse response of a body filter.

FIG. 10 illustrates an impulse response of a typical body filter of a natural musical instrument. Essentially, the impulse response is a damped oscillatory waveform. It is a response such as this which will be stored as the aggregate excitation signal in the most simple case in which the excitation is an impulse. In other cases where the excitation is other than an impulse, the aggregate excitation will be a convolution result as described above. Since the convolution is with an impulse response, the convolution result will in every case terminate with a damped oscillatory waveshape. However, it should be appreciated that various shortening techniques may result in an excitation signal which has other than a damped oscillatory shape. Such shortened excitations are derived from (and provide similar results to) the original impulse response.

Figure 12:
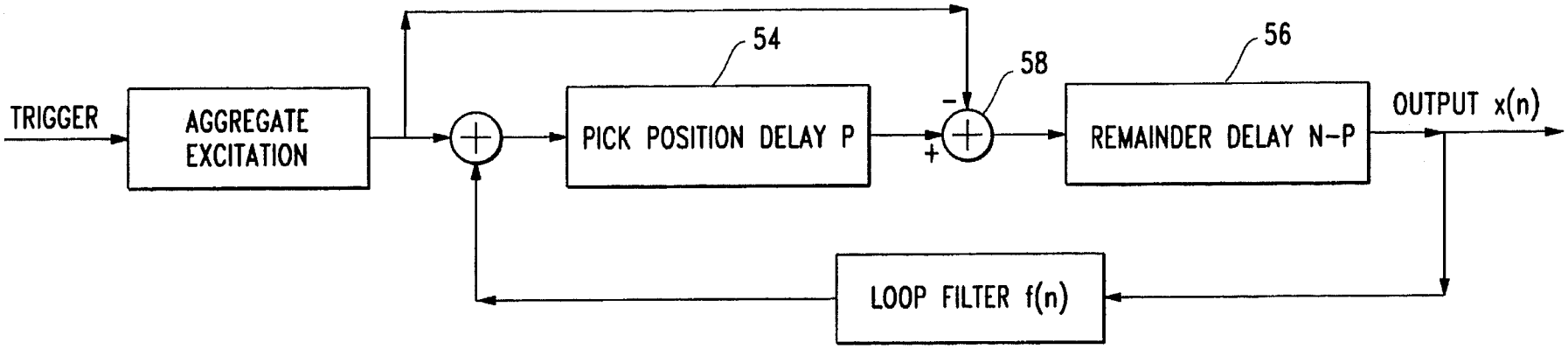
FIG. 12 is a block diagram of a tone generation system permitting simulation of variation of pick position.

The tone synthesis system can be employed to simulate different pick positions, i.e., inputting of an excitation at different points along a string. By exciting the string simultaneously at two different positions along the delay line and summing into the existing contents of the delay loop at that point, the illusion of a particular pick position on a string is simulated. This is illustrated in FIG. 12, where the delay is divided into two delays 54 and 56 and an adder 58 is inserted between the delays. In general, the ratio of the pick position delay to the total loop delay equals the ratio of the pick position to string length. The total delay length is N, the desired tonal period corresponding to the selected pitch (minus the delay of the loop filter).

Figure 13:
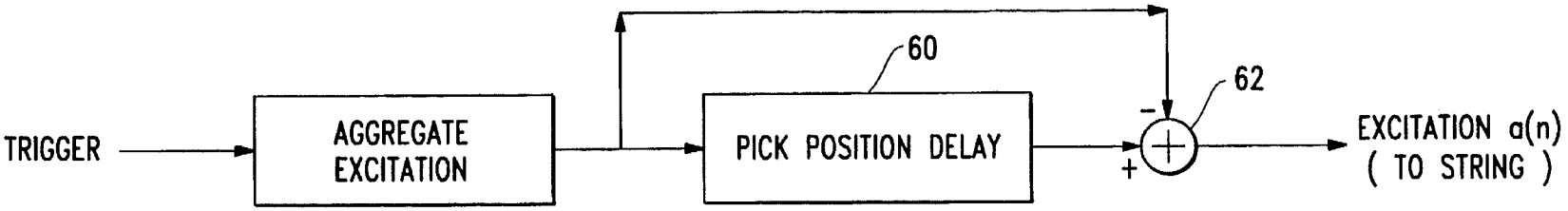
FIG. 13 is a block diagram illustrating an equivalent system to provide pick position variation.

A related technique is to delay the excitation and sum it with the non-delayed excitation to achieve essentially the same effect. This is illustrated in FIG. 13 in which a separate pick position delay 60 and adder 62 are provided. The pick position delay can be varied to control the effective pluck point of the string.

Figure 14:
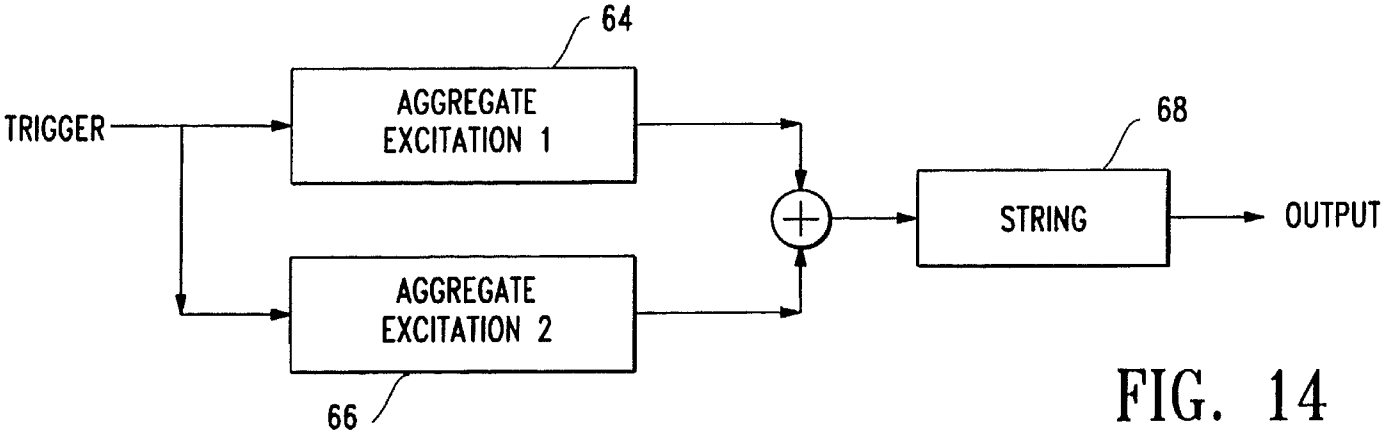
FIG. 14 is a block diagram of a system employing two excitation tables which are scaled and added together to produce a final excitation.

The tone synthesis system of the present invention may be modified to provide multiple excitation signals in order to achieve the effect of multiple radiation points of natural musical instruments and other effects. When listening to musical instruments made of wood and metal, the listener receives signals from many radiating surfaces on the instrument. This results in different signals reaching both ears. Furthermore, when the player moves the instrument, or when the listener moves his or her head, the mixture of sound radiation from the instrument changes dynamically. To address these natural phenomena, it is helpful to support multiple output signals corresponding to different output signals in a natural environment. In the present invention, this can be approximated simply by providing multiple aggregate excitation signals, each having different content reflecting different body filters or different overall resonant systems. This is illustrated in FIG. 14 in which aggregate excitation signals 64 and 66 are provided and are applied to a single string delay loop 68 (separate string loops can be provided if separate outputs are desired). Although only two aggregate excitations are illustrated, any number of excitations may be provided to further simulate different output points cross-fade. Interpolation between two or more tables may also be employed.

Figure 11A:
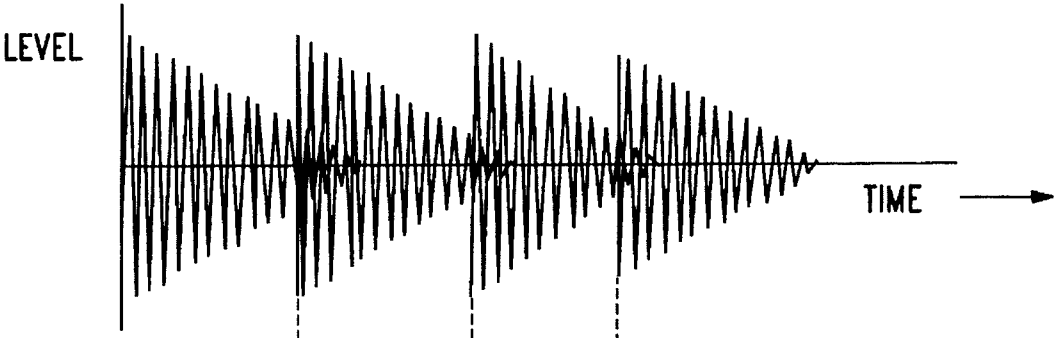
FIGS. 11A and 11*b* are illustrations of repetitive provision of an excitation signal in order to achieve sustained tone generation.
Figure 11B:
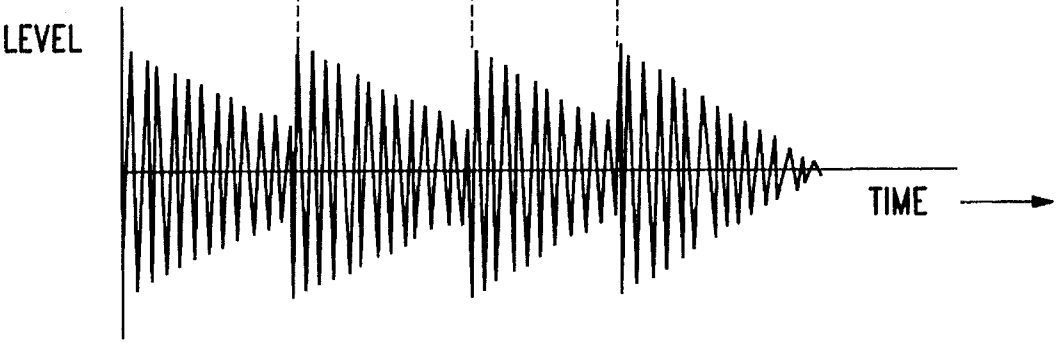

An important variation in the tone synthesis system is to play out the excitation table quasi-periodically. Instead of a single trigger to initiate a plucked string tone, the trigger is applied periodically (or near periodically, allowing for vibrato). In this instance, the amplitude of the excitation can be reduced (e.g., by right shifting table output values or imparting an amplitude envelope to the table output) to provide an appropriate output level. This technique is capable of extremely high quality bowed string simulation. Two variants are possible when a trigger occurs while the excitation table is still playing out. First, the excitation table may be restarted from the beginning, thus cutting off the playback in progress. This is illustrated in FIG. 11B. Alternatively, the start of a new excitation playback can be overlapped with the playback in progress as illustrated in FIG. 11A. This variant requires a separate incrementing pointer and adder for each instance of the table playback and thus is somewhat more complex. However, it is preferred from a quality standpoint.

Figure 15:
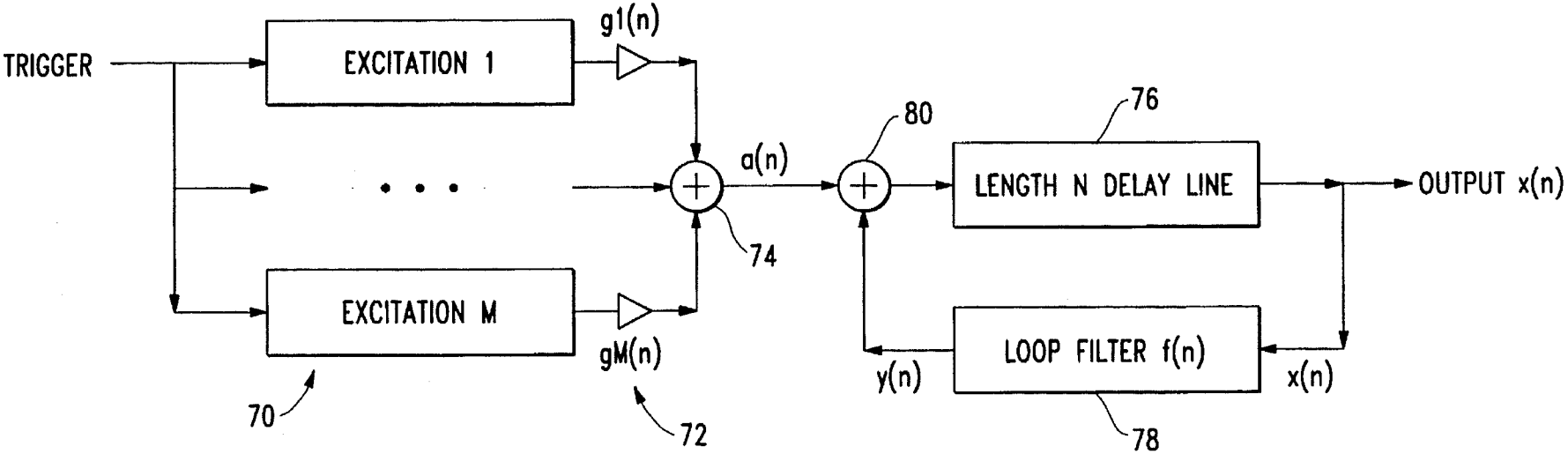
FIG. 15 is a block diagram of a tone synthesis system incorporating a time varying mixed excitation generator.

In addition to providing a mixed excitation as in FIG. 14, a useful variation is to provide plural excitations (tables or otherwise) and provide gain control for each excitation which may be varied over time. This is illustrated in FIG. 15 in which excitation generators 70 generate M excitation signals. Each excitation output has an associated gain control element 72, which may be varied over time. The outputs of the gain control elements are combined by means of an adder 74 to provide an aggregate excitation signal a(n). This signal is provided to the delay loop including delay line 76 and loop filter 78 via an adder 80. The provision of gain control for each of the excitations provides a means for synthesizing a wide range of excitations as a time-varying linear combination of a fixed set of excitations. That is, each excitation signal is fixed but its relative contribution to the overall excitation signal which is provided to the delay loop may be controlled by controlling the relative gain of each excitation signal. The gains may be set at a particular value and held for the duration of a note, or they may be varied over time to alter the character of the tone being generated, in addition to the alteration provided by the filtered delay loop itself.

In a free oscillation, e.g., a plucked tone, the gains gi(n) would typically be fixed, such that only one linear combination of excitations would be used. In a driven oscillation, e.g., a bowed string, the gains can be varied over time to alter the character of the tone. This may be accomplished by providing a smoothly varying envelope for each excitation to control the relative contributions of the different excitations. The variation over time achieved by altering the excitation is in addition to the time variation achieved in the filtered delay loop.

The nature of the various excitation tables may be selected to maximize the number of useful variations available from a fixed set of tables. A set of excitations may, for example, include a number of wave tables stored in ROM plus a filtered noise generator. The wave tables may provide various aggregate excitation signals taking into account different body filters, or may be based upon principal components analysis in which principal components (e.g. frequency) of overall desired excitations are separately provided in different wave tables and variably combined. This is similar to well known Fourier synthesis techniques used for standard tone generation (but not for excitation signal generation for delay loop tone synthesis).

The tone synthesis system illustrated in FIG. 15 is useful for simulating bowed string sounds. Generally, accurate simulation of such sounds requires a delay loop having a non-linear junction for receiving an excitation signal and a signal circulating in the loop and returning a signal in accordance with a non-linear function. The synthesis system of FIG. 15 does not require the complexity of a non-linear junction yet can provide a good approximation of a bowed string instrument by employing only a filtered delay loop and time varying excitation signal. In this regard, it should be noted that each individual excitation signal in itself is generally time varying but of a fixed relatively short duration. For a sustained tone such as a bowed string simulation, each excitation will be repeated plural times and time variation of the relative strengths of each excitation provides desirable tonal variation.

Figure 16:
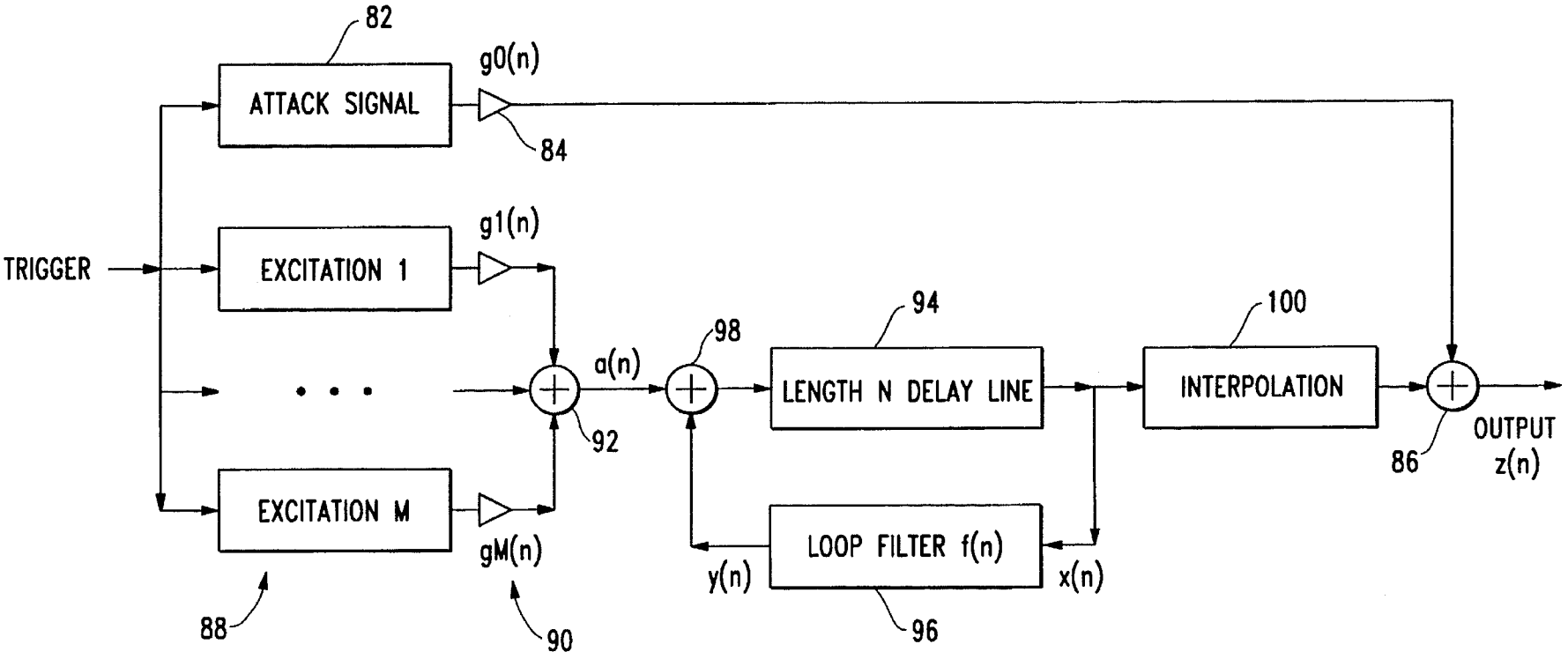
FIG. 16 is a block diagram of a tone synthesis system incorporating an excitation generator for providing an attack component outside of the delay loop.

An additional modification which provides significant computational advantages is illustrated in FIG. 16. The initial attack portion of a tone generally includes significant high-frequency information. In order to properly synthesize the attack portion in a conventional filtered delay loop, the loop filter sampling rate must be maintained relatively high. This is not the case with respect to remaining portions of the synthesized tone, which have significantly fewer high frequency components. The present invention significantly reduces computational requirements by providing a separate attack signal as one of the excitation signals and routing it around the filtered delay loop as illustrated in FIG. 16. The attack signal is a high-frequency short duration signal (e.g., 100 msec) which is read out in response to the trigger signal in parallel with additional excitation signals. In FIG. 16, the attack signal is provided at 82, gain control by an amplifier at 84 and provided to an output summing junction 86. Additional excitation tables provided at 88 are appropriately weighted at 90 and summed at 92 to provide a composite excitation signal e(n) to be input into a filtered delay loop including delay line 94, loop filter 96 and adder 98. Significantly, the sampling rate in the loop filter may be quite low in view of the lack of necessity to process high-frequency components. For example, in a reduced-cost implementation for a low-pitched note such as the low E on a guitar, excitations which enter the string loop may be restricted to below 1.5 KHz, and the first 100 msec of a recorded note high passed at 1.5 KHz may be used for the attack signal. A sampling rate of 3 KHz may be employed for the delay loop. The output signal of the loop may be up-sampled to 22 KHz by means of an interpolation circuit 100 and added to the attack signal (which is also provided at a 22 KHz sample rate). The composite output signal z(n) includes both higher and lower frequency components which are desired, yet the processing of the delay loop is substantially simplified. The sampling rate of the string loop may be controlled as a function of pitch.

The synthesis technique of the present invention can also be extended to tonal percussion in instruments, such as vibraphone and other percussion instruments such as tom-toms, marimba, glockenspiel, etc. which have a small number of exponentially decaying resonant modes. In these cases, plural filtered delay loops can be summed to provide the most important resonant modes, approximating them as a sum of nearly harmonic modal series. The technique can also be applied to wind instruments. The excitation table in this case provides the impulse response from inside of the tube of the instrument to outside the tone holes and bell. Due to the lack of a non-linear junction giving interaction between the sound waveform and the excitation (and which is typically used in physical simulation of wind instruments), natural articulations are difficult to obtain. However, the technique provides a simple, reduced cost implementation.

Another embodiment of the present invention is illustrated in FIGS. 17A–22. This embodiment reduces the size of the excitation tables, and hence the costs associated with the present invention, by separating the resonator into "damped" and "ringy" modes. The least damped resonances are factored out and only the more damped portion of the resonator which remains is commuted with the string.

As was discussed above with respect to FIGS. 7 and 8, in the simplest case the aggregate excitation table 52 essentially becomes the sampled impulse response of the chosen resonator (e.g., of a guitar body). In more elaborate cases, the aggregate excitation signal is given by performing the convolution shown in Equation (1) in which the impulse response of the resonator is convolved with an excitation signal e(n).

The length of the resonator impulse response r(n), which will impact the length of convolution result and hence the aggregate excitation signal which is stored in the table, is determined by its least damped resonance. The inventor has found that by factoring out the least damped resonances, i.e., the long-ringing modes, from the more damped resonances, the portion of the resonator which is commuted with the string includes only the more damped resonances. This portion of the resonator has a much shorter impulse response. The non-commuted, long-ringing portion of the resonator can be modeled with a small number of two-pole filter sections or other recursive filter structure. It should be understood that the present invention is in no way limited to a digital filter implementation, and that any suitable digital or analog filter structure may be utilized with the present invention. Since most present day synthesizers employ a number of "extra" filters to impart post-processing effects on generated musical tone signals, the present invention can utilize these filters to act as the "ringy" portion of the resonator so as to greatly simplify the excitation tables needed to accommodate the aggregate excitation signals.

Figures 17A, 17B, 17C, 17D:
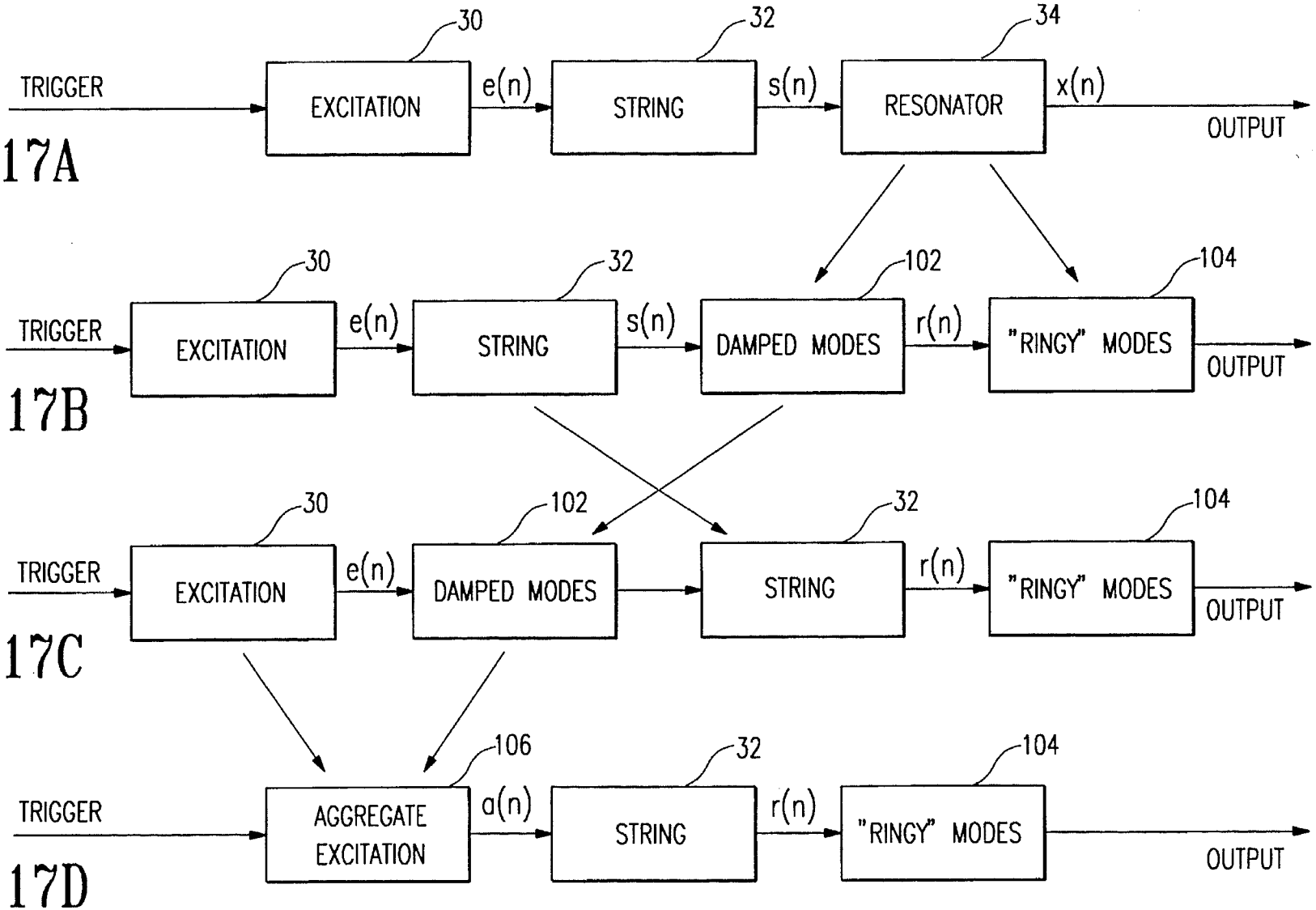
FIG. 17A is a block diagram of the sound generation mechanism of a guitar.
FIG. 17B is a block diagram of the sound generation mechanism of FIG. 17A in which the resonator has been factored into a damped mode resonator and a ringy mode resonator.
FIG. 17C is a block diagram of the sound generation mechanism of FIG. 17B in which the damped mode resonator component is placed before the string.
FIG. 17D is a block diagram of the sound generation mechanism of FIG. 17C in which the excitation has been convolved with the damped mode resonator.

In FIG. 17A, a block diagram of a sound generation mechanism is shown, for example for a guitar, in which a trigger is supplied to an excitation source 30 which in turn produces an excitation signal e(n) for exciting the string portion 32. The string portion produces the output signal s(n) which excites resonator 34 which produces the eventual output signal x(n). The characteristics of the resonator 34 are the same as those discussed in conjunction with FIGS. 4–6.

Rather than immediately commuting the resonator 34 with the string 32 as was done in previous embodiments, the characteristics of the resonator 34 are first factored into a "damped" resonator 102 and a "ringy" resonator 104 as shown in FIG. 17B. Typically, the resonator 34 is first studied in the form of a measured impulse response. The measured impulse response may be obtained, for example, using a force-hammer, two channels of analog-to-digital (A/D) conversion, and some system identification software, such as is that available for the MatLab (TM) programming environment which is known to those skilled in the art. One A/D channel records the force-hammer output which is proportional to the striking force applied by the hammer. The other A/D channel records, for example, a microphone output which measures the resonator's response to the hammer strike. The system identification software essentially deconvolves the force-hammer "input" signal out of the measured microphone "output" signal to form a measured impulse response estimate. A simple technique for accomplishing the deconvolving function is to divide the Fourier transform of the "output" by the Fourier transform of the "input" to obtain the measured frequency response of the resonator. Alternatively, commercially available software packages can be employed to provide a more sophisticated deconvolving process. Using either technique, the inverse Fourier transform of the frequency response yields the impulse response.

After the impulse response of the resonator 34 has been determined, the most ringy modes of the impulse response are converted to "parametric form." That is, the precise resonance frequencies and resonance bandwidths associated with each of the narrowest "peaks" in the resonator frequency response are ascertained and relegated to the "ringy part" 104. The longest ringing times are associated with the narrowest bandwidths. The longest ringing modes also typically comprise the tallest peaks in the frequency response magnitude. As such, an effective technique for measuring the resonances having the longest ringing times is to find the precise location and bandwidth of the narrowest and tallest spectral peaks in the measured frequency response of the resonator 34. The center-frequency and bandwidth of a narrow frequency-response peak determine two poles in the ringy part of the resonator 104. Expressing a filter in terms of its poles and zeros is one type of "parametric" filter representation, as opposed to "non-parametric" representations such as the impulse response or frequency response.

As is known to those skilled in the art, commercial system identification products are available which include software for converting measured frequency-response peaks to parametric form. Some such commercial products include a force hammer and a complete data collection facility. In addition, those skilled in the art are familiar with the signal-processing literature devoted to this problem. As an example, "Prony's method" is a classical technique for estimating the frequencies and bandwidths of sums of exponentially decaying sinusoids (two-pole resonator impulse responses). A more sophisticated and recent technique is called the "matrix pencil method."

Figure 18:
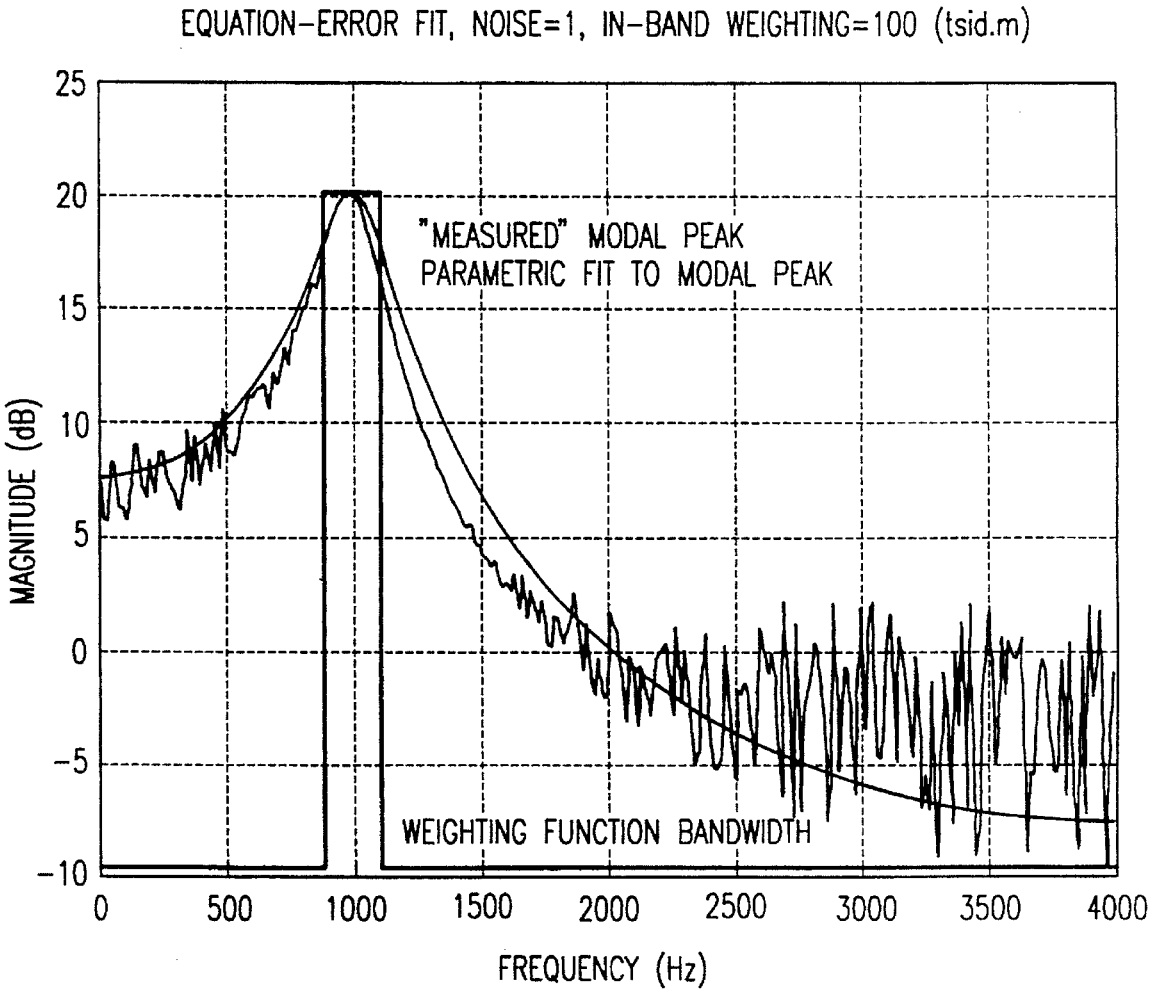
FIG. 18 is a graphical representation of an overlay of a non-parametric frequency response, a parametric frequency response fit, and a weighting function.

FIG. 18 illustrates in graphical form a method for conversion of the ringy portion 104 of the resonator 34 into parametric form which was carried out using a small MatLab program. For simplicity, only one frequency-response peak is shown in this example. First, the peak center-frequency is measured using a quadratically interpolating peak finder operating on the dB spectral magnitude. Next, a general-purpose filter design function "invfreqz( )" is called to design a two-pole filter having a frequency response that approximates the measured data as closely as possible. The known "equation-error method" for digital filter design can be used to obtain the parametric filter coefficients (as was done in this example). To force the filter-design program to focus on the spectral peak, a weighting function is employed, as also shown in FIG. 18 (after being re-normalized to overlay on the plot). The weighting function used in this example is "1" from 0 Hz to 900 Hz, then "100" from 900 Hz to 1100 Hz, and then reverts to "1" thereafter. The weighting function appears in FIG. 18 as the rectangular function centered about the spectral peak at 1000 Hz. Finally, FIG. 18 shows an overlay of the magnitude-frequency-response of the two-pole filter that was designed by the equation-error method. As can be seen in the Figure, the fit between the non-parametric frequency response and the parametric frequency response is quite close near the peak. The interpolated peak frequency measured initially can be used to fine-tune the pole-angles of the designed filter, thus rendering the equation-error method a technique for measuring only the peak bandwidth in this case. As is known to those skilled in the art, there are numerous techniques in the signal processing art for measuring spectral peaks, and it is to be understood that the present invention is not limited to use with the illustrated technique.

Another method for converting the ringy portion 104 of the resonator 34 into parametric form is to use the well-known Linear Predictive Coding (LPC) technique followed by polynomial factorization to obtain resonator poles. LPC is particularly good for modeling spectral peaks. The poles closest to the unit circle in the z plane can be chosen for the "ringy" portion 104 of the resonator 34.

When using LPC, or any other "minimum phase" parametric form for the long-ringing resonator 104, the corresponding damped portion 102 can be computed from the full impulse response of the resonator 34 and the parametric or ringy portion 104 using what is called "inverse filtering," an operation which is well known, especially in the contexts of linear predictive coding and system identification. The inverse filter is formed by preparing an all-zero filter whose zeros are equal to the poles of the ringy portion 104. If the ringy portion 104 has zeros, they become poles of the inverse filter, and hence they must be stable. In the case of digital filters, the zeros must have a magnitude less than one in the Z-plane. For analog filters, the zeros must lie in the left-half of the S-plane. Such filters are called "minimum phase." To reduce the likelihood of obtaining non-minimum phase zeros in the estimated parametric form of the ringy position 104, it is sometimes helpful to convert the initial resonator impulse response to its minimum phase counterpart using non-parametric methods such as the known cepstral "folding" technique.

In either the digital or analog case, if the zeros are non-minimum phase, they may be reflected about the appropriate frequency axis to obtain a minimum-phase filter with the same frequency-response magnitude. The inverse filter is then applied to the full impulse response of the resonator to obtain a "residual" signal. This residual signal is the impulse response of the "damped part" 102 and is suitable for commuting with the string and convolving with the string excitation signal such as a "plucking" signal. If the residual signal is fed to the ringy portion 104, or parametric resonator, (a minimum-phase filter in this case), a highly accurate realization of the original impulse response of the resonator 34 is obtained, with the accuracy generally being affected merely by numerical round-off errors which occur during the inverse and forward filtering computations.

All-pole filters have been determined by the inventor to be convenient and easy to work with. They are always minimum phase, and the LPC technique will compute them readily. As those skilled in the art will appreciate, many filter design techniques exist which can produce a parametric portion having any prescribed number of poles and zeros, and weighting functions can be used to "steer" the methods toward the longest ringing components of the impulse response 34. The equation-error method illustrated in graphical form in FIG. 18 is one example of a method which can also compute zeros in the parametric or ringy portion as well as poles. Thus, the parametric portion 104 may have any number of poles and zeros, and it may be implemented using any known filter realization technique.

Known digital filter realization techniques include series and parallel connections of second-order filter sections. It is known in the art that the transfer function of any linear, time-invariant (LTI) filter can be factored into a series connection of elementary second-order sections. It is also known that every LTI filter can be split into a sum of parallel second-order sections by means of a "partial fraction expansion" calculation. Each second-order section can resonate at only one frequency, or not at all.

Figure 19A:
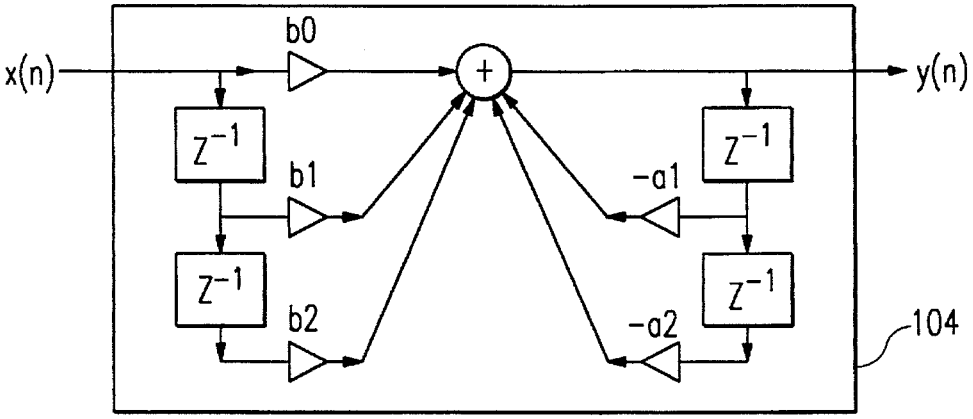
FIGS. 19A, 19B, 19C and 19D illustrate alternative realization structures for digital resonators.

A diagram of a "Direct Form I" realization of a general second-order filter section (up to two poles, up to two zeros, and a gain factor) is shown in FIG. 19A. There are several alternative realizations, but the Direct Form I is a good choice from a numerical point of view because all the multiplier outputs connect to a common adder, typically using 2's complement arithmetic. As a result, overflow can only occur at one place—the output. For highest quality, the feedback signals (all those to the right of scaling coefficients b0–b2 in the Figure) may be implemented in double precision. Coefficient b0 in FIG. 19A can be eliminated when the Excitation Table is scaled accordingly. Each of the delay elements illustrated (as denoted by "$Z^{-1}$") provides a single unit of delay (one sampling interval).

If a second-order section resonates at all, its resonance frequency and bandwidth are determined by feedback coefficients a1 and a2 according to the following formulas:

$$a1=-2\,R\cos(2\,Pi\,Fr/Fs) \tag{2}$$

$$a2=R^2 \tag{3}$$

where Fr is the resonance frequency in cycles per second or Hertz (Hz), Fs is the digital audio sampling rate in Hz, Pi is 3.141 . . . , and R is the pole radius which relates to resonant bandwidth Br via the equation $$R=\exp(-Pi\,Br/Fs) \tag{4}$$

The time-constant of decay Tr for a second-order resonator is related to bandwidth by $$Tr=1/(Pi\ Br) \quad (5)$$

The time constant is defined as the time in seconds over which the resonator impulse response decays by the factor 1/e=exp(−1). In the present embodiment, it is necessary to identify the "ringiest" second-order sections, i.e., those having the longest decay time Tr (or, equivalently, the smallest bandwidth Br). These sections may then be implemented explicitly as second-order sections in the parametric portion 104 of the body resonator 34.

Figure 19B:
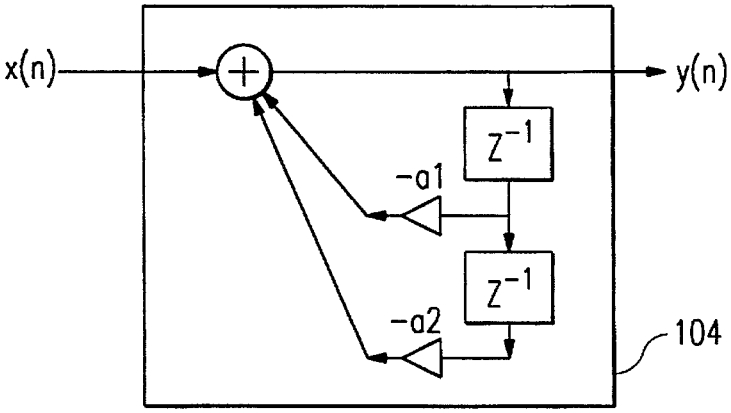
Figure 19C:
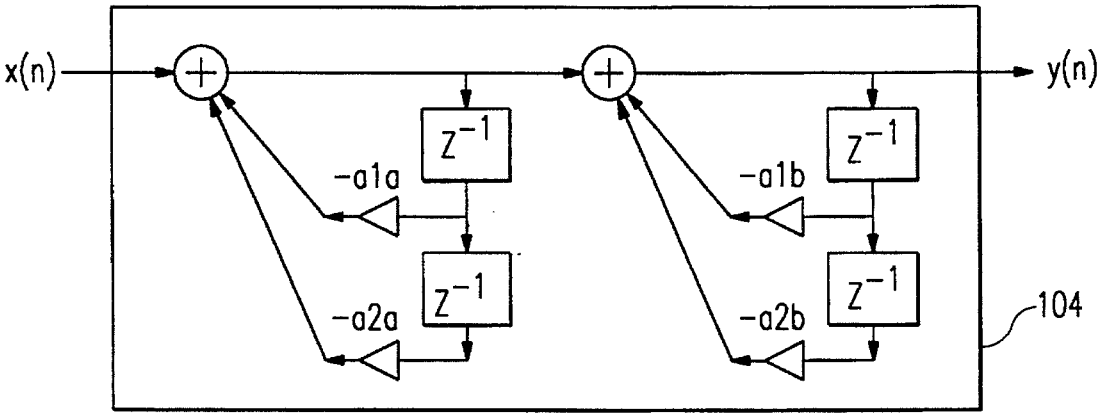

FIG. 19B shows a less general second-order resonator which possesses only two poles. This form can be used when the parametric portion 104 is chosen to be all-pole and the sections are connected in series. FIG. 19C illustrates the series connection of two two-pole sections. While perhaps the most convenient choice, the inventor has found that the numerical behavior is not as good, in general, as that of a parallel connection of second-order sections which can be seen in FIG. 19D in which two second-order sections are connected in parallel. As those skilled in the art will recognize, the partial fraction expansion of any proper transfer function yields parallel second-order sections each having at most one zero and up to two poles.

Figure 19D:
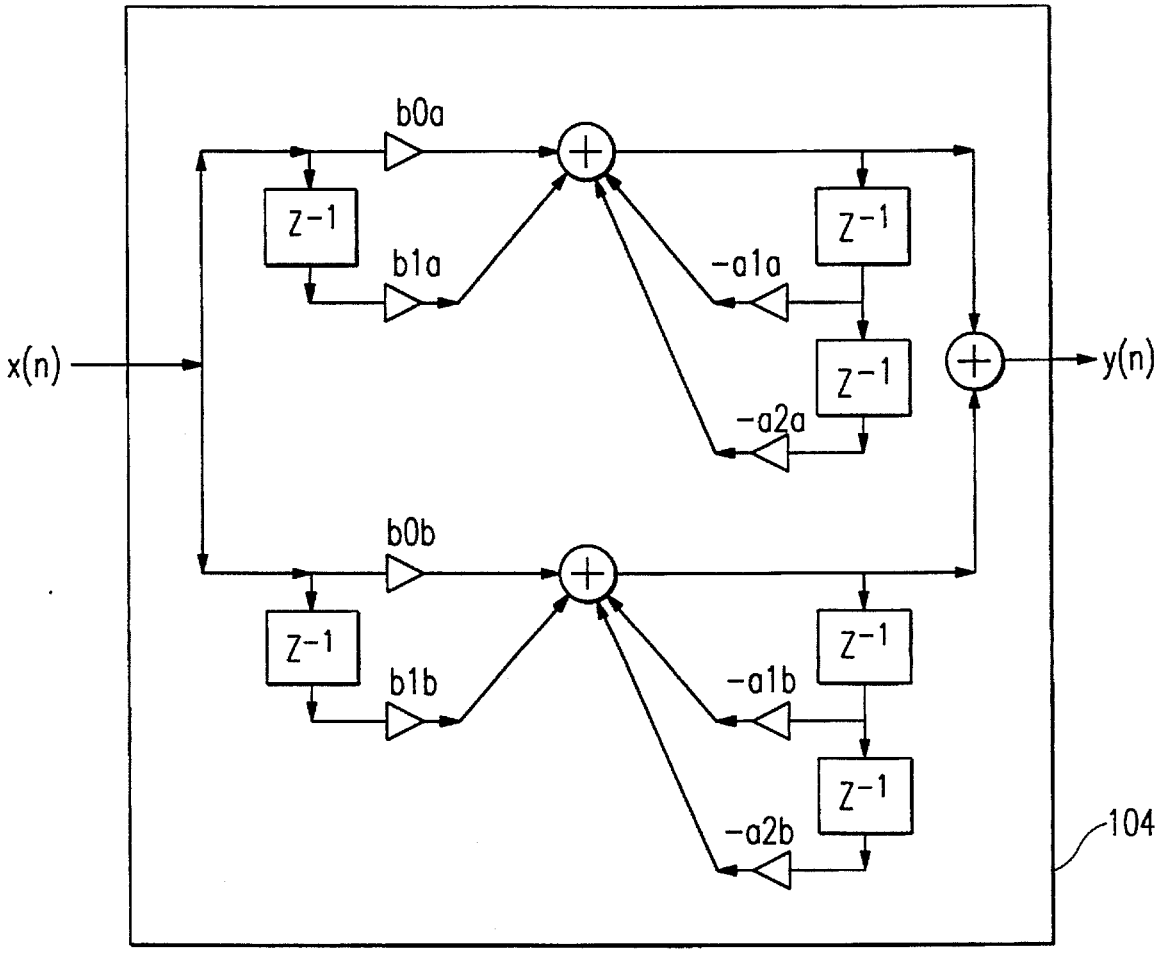

In general, when a digital filter possesses disjoint resonances (i.e., they don't overlap significantly in the frequency domain), it is numerically preferable to use parallel second-order sections rather than series second-order sections. This can be seen by considering that in order to obtain a resonance peak at some frequency in the series case, it is necessary also to compensate for signal attenuation by all the other filter sections which are not resonating. In a parallel combination, on the other hand, a resonating section acts essentially alone at resonance. Thus, parallel second-order sections as illustrated in FIG. 19D are generally numerically superior to series second-order sections as shown in FIG. 19C. However, they are less convenient to compute and require a zero in each section for proper phase alignment of the section outputs.

The effects processor on most commercially available musical tone synthesizers usually includes "parametric equalizer sections." Each of these sections is typically a second-order resonator section as shown in FIG. 19A with b0, b1, and b2 constrained to give only a gain control. The equalizer parameters are usually center-frequency, bandwidth, and gain, for each section. Thus, parametric equalizer sections ordinarily used to adjust the mixture of various frequency bands in the synthesized tone can also be used to implement the ringy modes of a desired body resonator.

Once the factoring of the resonator is completed and the parametric or ringy mode portion 104 is realized, the damped portion 102 which includes the most damped resonances of the resonator 34 is then commuted with the string 32 as was done in the previous embodiments as seen in FIG. 17C. The damped resonator 102 is then convolved with the excitation 30 using, for example, Equation (1) above, to produce the aggregate excitation 106 as seen in FIG. 17D.

Thus, in this embodiment, the trigger is supplied to the aggregate excitation 106 which excites the string 32 through an excitation signal a(n). In turn, string element 32 processes the input signal and produces an output signal r(n) which does not include the long-ringing components of the resonator 34. These components are supplied via the ringy mode resonator 104 which may comprise a series or parallel connection of resonating filters, e.g., a number of two-pole filter sections, depending upon the nature of the signal being synthesized. The resulting signal output from the ringy mode resonator 104 becomes the musical tone signal.

An additional advantage in having a separate parametric or ringy mode resonator section 104 is that plural output signals become available, while in the unfactored resonator 34, only one output signal was readily available. Multiple outputs can be used to enhance the quality of the synthesized tone in various ways. As one example, the outputs of the parallel second-order resonator sections may be "panned" stereophonically to different locations. This panning can be chosen to mimic the spatial distribution of the resonant modes of the simulated instrument. By changing the stereo placement slightly, an instrument moving in space can be simulated. To implement varied stereo placement of the individual resonators in the parametric or ringy mode portion 104, the adder receiving the two resonator outputs in FIG. 19D is replaced by two adders, one for the "left channel" and one for the "right channel." Also, for each resonator two scaling means, e.g., multipliers, would be used, one which scales the output before it is summed into the left channel, and a second which scales the output before it is summed into the right channel. By adjusting the respective scaling coefficients, the amount of the output signal which is fed to the left and right channels will determine the stereo placement of the signal. When the two scaling means are present, it is possible to eliminate one of the "b" coefficients in each section (e.g. b0*a* and b0*b* in FIG. 19D). Thus, only one additional multiplier is necessary for stereo placement. Also, since the angle of stereo placement is often not very critical, the two scaling coefficients may be specially quantized numbers which do not require multiplications, such as numbers which can only assume the values 0, 1/8, 1/4, 3/8, 1/2, 5/8, 3/4, 7/8, 1. Multiplication by these numbers, for example, can be computed (in binary fixed-point) using one or two shifts and zero or one fixed-point addition or subtraction.

Figure 20A:
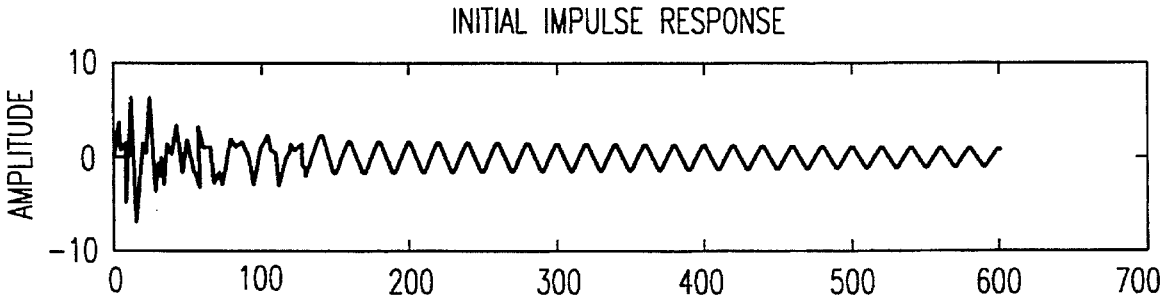
FIG. 20A is a graphical representation of a simulated impulse response of a guitar body resonating at 100 Hz.
Figure 20B:
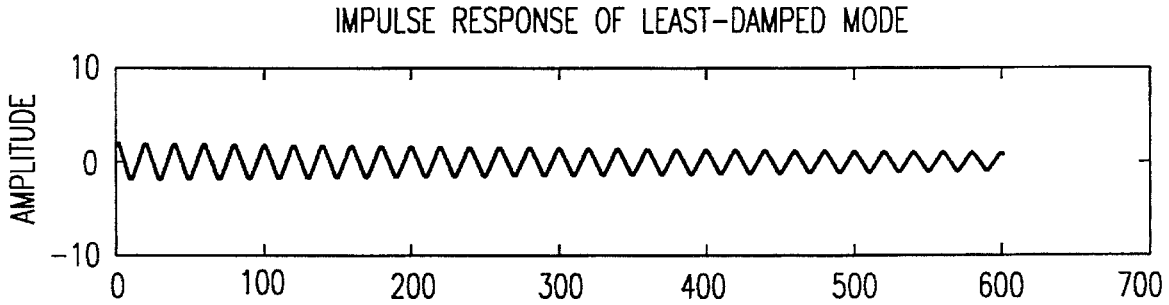
FIG. 20B is a graphical representation of the longest ringing mode (least damped component) of the impulse response shown in FIG. 20A.
Figure 20C:
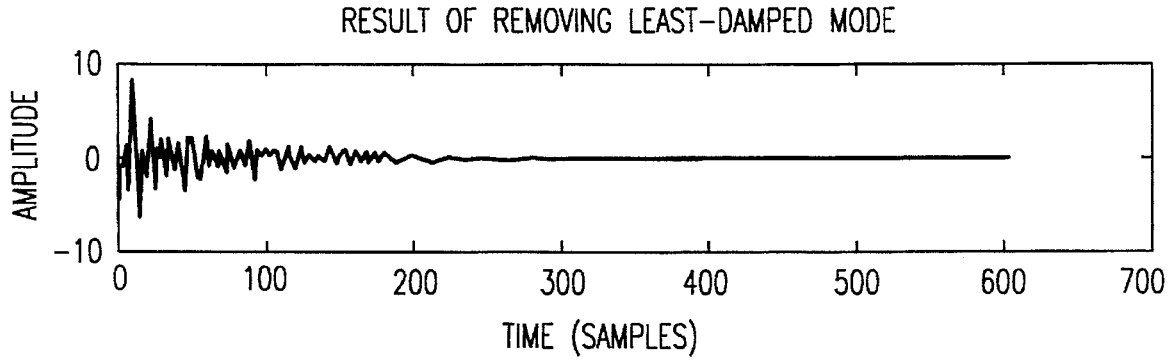
FIG. 20C is a graphical representation of the initial impulse response shown in FIG. 20A in which the least damped component of FIG. 20B has been factored out.

The reduction in the size of the excitation table which is achievable using the technique of the present embodiment can be illustrated by observing the synthesized impulse response of an idealized guitar body before and after a single least damped mode is factored out. FIG. 20A shows the initial impulse response of a simulated guitar body which resonates at 100 Hz. In a guitar, as is known, the main air resonance of the guitar body generally provides the longest ringing resonance. It therefore produces the least damped ringing component of the body impulse response such as that shown in FIG. 20B. As can be seen in FIG. 20C, by factoring out this single, second-order, least damped resonator component at 100 Hz, the excitation table can be shortened by an order of magnitude. In this example, the factored out component could be modeled with, for example, a single second-order resonating filter 104 as shown in FIG. 19B having a resonant frequency of 100 Hz.

Figure 21A:
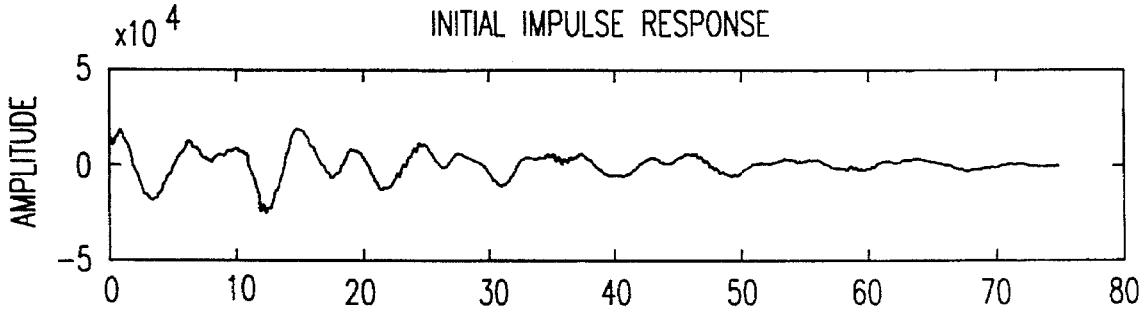
FIG. 21A is a graphical representation of a guitar body impulse response calculated from measured data obtained from an actual guitar.
Figure 21B:
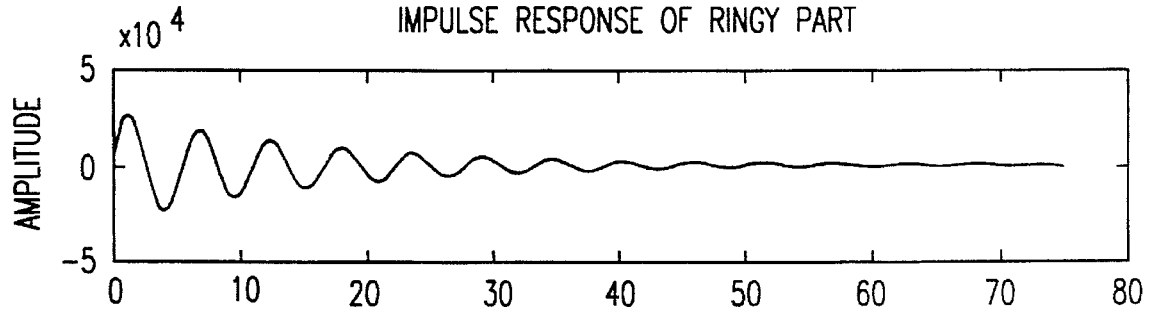
FIG. 21B is a graphical representation of a parametric estimate of the two longest ringing modes in the impulse response shown in FIG. 21A.
Figure 21C:
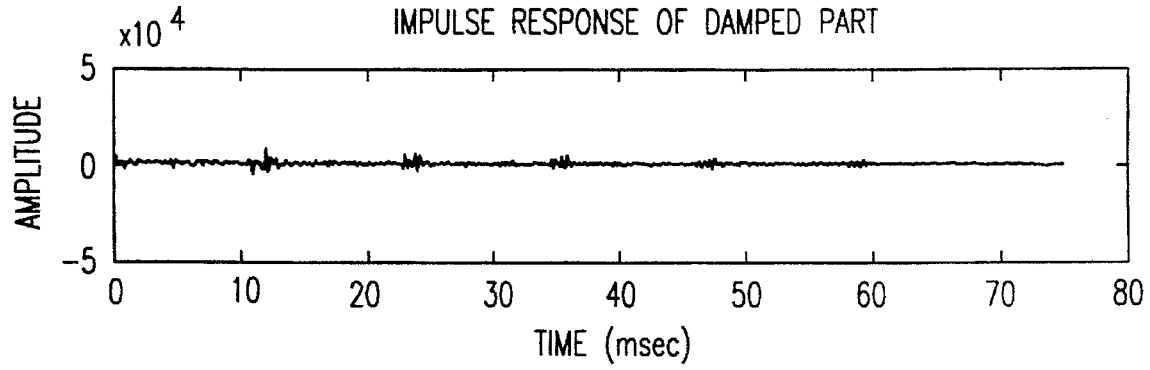
FIG. 21C is a graphical representation of the impulse response shown in FIG. 21A in which the parametric component of FIG. 21B has been factored out using inverse filtering.

A similar example using measured data from an actual classical guitar is shown in FIGS. 21A–C. FIG. 21A shows the estimated impulse response of the resonator 34 which has been converted to minimum phase using the known cepstral "folding" method. In this case, there are two long-ringing, low-frequency resonances, one near 110 Hz and the other near 220 Hz. Since there are two ringing resonances, each of which gives rise to a spectral peak in the frequency response, the parametric resonator portion 104 must include at least four poles. The impulse response of the four-pole parametric portion 104, computed using the equation-error method, is shown in FIG. 21B. Inverse filtering was performed, and the residual impulse response 102 is shown in FIG. 21C. The small noise bursts which appear at roughly 12 msec intervals are associated with the pitch of the guitar string which was excited in order to make the illustrated measurement, and are not relevant to the example.

The reduction in the size of the excitation table achieved in accordance with this embodiment of the present invention contributes considerable cost savings to the overall musical tone synthesizer. In addition, since this embodiment utilizes relatively simple resonating filters to model the "ringy" mode resonator, and since such filters are typically already present in most synthesizers currently being produced, there need be no added equipment costs in such situations.

The cost savings obtained by extracting the longest-ringing resonant modes from the impulse response of the resonator 34 into d parametric portion 104 depends, among other things, on: (1) the duration of the impulse response, (2) the duration of the impulse response remaining after extracting the longest-ringing modes, (3) the cost of memory, and (4) the cost of a second-order filter section implementation. Current hardware trends are providing faster processors in progressively more confined configurations in which only a small amount of memory is locally available. It is often the case that reduction of memory usage at the expense of more processor utilization is a welcome trade-off.

Thus, this embodiment is in keeping with the overall impetus for the first embodiment discussed above, i.e., to eliminate the expensive and complicated body filters required in the prior art. However, in this embodiment, the inventor has found that by factoring the resonator into components based on the damping components thereof, that portion of the resonator which is relatively simple to model using resonating filters can be maintained while the much more complex damped portion can be convolved with the excitation to create an aggregate excitation which provides for downstream resonant characteristics.

Furthermore, this technique simplifies the tone synthesis operation by eliminating most of a very large resonator and reducing the size of the excitation tables, while taking greater advantage of the capabilities of the synthesizer by using existing resonating filters to provide the ringy mode resonator. It is fully capable of being employed with the other embodiments, including the use of plural excitation tables such as those shown in FIGS. 14–16.

Figure 22:
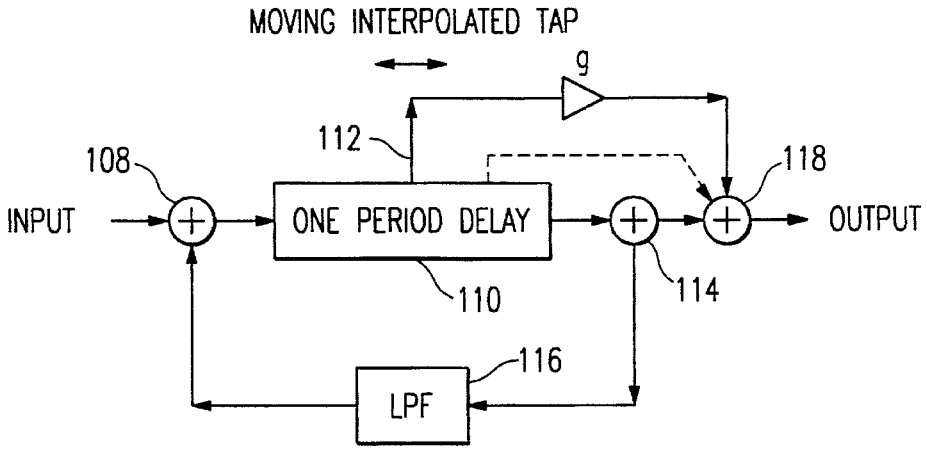
FIG. 22 is a block diagram of a tone synthesizing system in which a filtered delay loop is configured with a moving interpolated tap to synthesize a self-flanging string or a virtual detuned string.

While the embodiment of the invention discussed above in conjunction with FIGS. 17A–21C can also be employed with the delay loops of the previously discussed embodiments such as those illustrated in FIGS. 3, 12, etc., FIG. 22 illustrates an enhanced filtered delay loop capable of simulating a self-flanging string or a virtual detuned string. As seen in the Figure, an input (e.g., a(n)) is supplied to an adder 108 and to a one period delay element 110. The delay 110 provides two outputs. A first output represents the moving interpolated tap 112, i.e., an output taken from a continuously changing location along the line of the delay 110 and thus delayed an amount proportional to the point at which the output is taken. This output can be scaled via scaling coefficient g, which may be a time-varying value. The output of the delay is also provided to an adder 114, which in turn feeds back to a low pass filter 116 and then back to adder 108. The output of the moving interpolated tap is supplied to an adder 118 which is located downstream from adder 114 and outside of the delay loop.

The above construction allows the present invention to accomplish several features while providing an effect that is typically costly in string synthesizers. First, a flange string can be achieved using a slow back and forth moving interpolated tap. Ideally, multiple independently moving taps will provide the best flange effect (e.g., as illustrated by the dashed lines in FIG. 22). Each tap adds a moving comb filter to the output.

A single, non-moving tap can provide the fixed comb filtering needed for simulating the location of a pluck, strike, or other excitation along the string. A non-moving tap does not require interpolation in this case because the exact location of the physical excitation is not sufficiently audible.

In addition to the flanging string simulation, a detuned "second string" can be simulated using a faster unidirectional moving tap. In this situation, the tap speed corresponds to the Doppler shift created. The faster the moving tap moves to the right in FIG. 22, the lower is the Doppler shift of all the frequencies in the input signal. The faster it moves to the left, the higher is the Doppler shift of the frequencies. In this embodiment, when the moving tap reaches the end of the delay line, it must "wrap" around to the other side in some way. In the simplest case, a simple wrap-around can be used. A better sound is obtained by cross-fading such that the output of the tap at the exit end of the delay line fades to zero at the same time that the output of a second tap reading the entrance end of the delay line fades in. Thus, in this case, two moving interpolated taps are active during the cross-fade. A further refinement is to look for good places along the delay line to jump from and to. For example, wrap-around can be made to occur on zero-crossings when possible, or a cross-correlation can be computed at various lag points. These techniques are all somewhat known in the context of "harmonizer" and "pitch shifting" algorithms. By adding additional taps at different tap speeds, it is possible to simulate additional detuned strings. By creating multiple virtual strings in this way, all at slightly different tunings which change over time, a pleasing "chorus effect" is obtained.

Flanging and Doppler shift can be used to imitate the effect of coupled vibrating strings. Coupling normally results in slow "beats" in the amplitude envelope of the overtones of a ringing note. A moving comb filter (with notches that are not too deep) can produce a qualitatively similar effect by means of flanging. Alternatively, summing a string output with a virtual detuned string can accomplish the same effect. As a specific example, setting the scaling coefficient g in FIG. 22 to 0.25, and setting the tap speed so as to produce a Doppler frequency shift of 0.25%, the resulting sum of two slightly mistuned strings produces beating similar to that observed in an electric guitar.

In operation, simulating coupled strings, which is a necessity in virtually all stringed instrument synthesis, becomes cost-effective when employing the present invention. In the prior art, a plurality of string simulators were required to simulate a corresponding plurality of coupled strings. In the present invention, only a single string simulator is employed with the effects of coupling being imparted by one or more moving taps.

Figure 23:
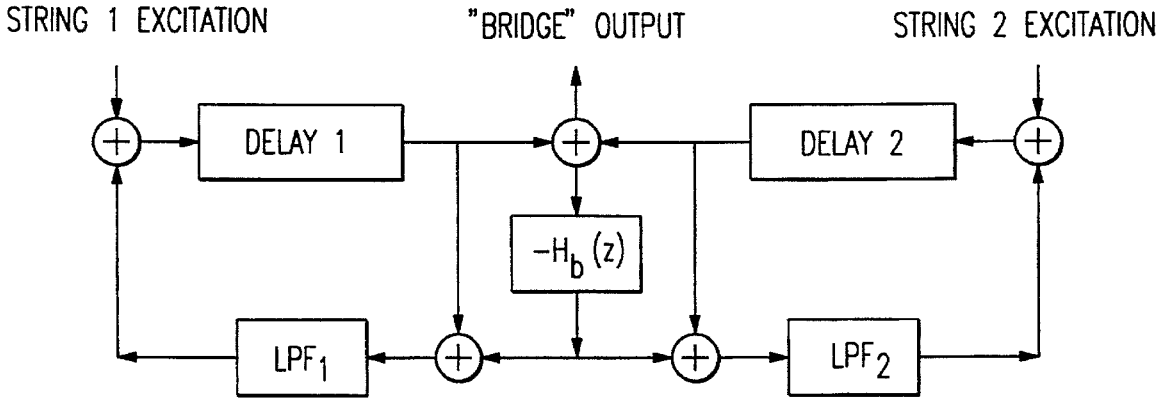
FIG. 23 is a block diagram of an embodiment of a string coupling simulation technique.

As an alternative to the disclosed coupled string simulation technique, it is possible to couple two filtered delay loops, each of which simulate a string as shown in FIG. 23. In this alternative implementation, the outputs of each filtered delay loop are summed, and the combined signal is scaled using a negative coefficient, preferably having a magnitude on the order of 0.01 or less. For more accurate coupling simulation, as seen in FIG. 23, the negative coefficient can be replaced by a filter with a transfer function $-H_b(z)$ which can be computed from measured or theoretically predicted coupling characteristics. The scaled or filtered signal is then added back into each of the filtered delay loops by way of feedback path and is preferably introduced into the loop at a location immediately succeeding the location at which the output was taken from the loop. The output used for coupling purposes may be taken at any desired location about the loop.

This true-coupling approach generalizes to N strings as follows. The outputs from N filtered delay loops (corresponding to N strings) are summed together, the combined signal is scaled by—epsilon (or filtered by $-H_b(z)$), and the scaled (or filtered) signal is then added into each of the filtered delay loops by way of a feedback path, and is preferably introduced into each loop at a location immediately succeeding the location at which the output was taken from the loop. The scaled (or filtered) signal represents a physical interpretation of the "bridge" output. Either the scaled signal, or in most cases the unscaled combined signal before scaling, provides an excellent choice for the aggregate output of the coupled string assembly. When a filter $-H_b(z)$ is used as opposed to a negative coefficient to implement true coupling, it is possible to eliminate the loop filters in all of the filtered delay loops which are coupled together. That is, it is possible to use the coupling filter $-H_b(z)$ to provide all the filtering needed in all of the delay loops which are coupled. When the individual loop filters are not utilized, the coupling filter can be regarded as a shared loop filter.

Moreover, these effects (namely, flanging, detuned string, chorus, virtual coupling, true coupling, etc.), can be utilized with any synthesis technique that employs a filtered delay loop. Examples include waveguide synthesis of wind, brass and tonal percussion instruments.

In summary, by providing an excitation signal corresponding to a triggered impulse response, with optional preprocessing of the impulse response, high quality "plucked," "struck," "bowed," and otherwise excited tones can be synthesized without the need for expensive and complex body filters. The characteristics of a resonant system downstream of a vibrating element such as a string may be provided for by properly deriving an excitation signal which takes into account the impulse response of the downstream resonance system. The tone synthesis technique is greatly simplified as compared to systems requiring complex body filters. In addition, by factoring the resonator into damped and ringy modes, and then commuting the damped mode with the string and convolving it with the excitation, it is possible to reduce the size of and the cost associated with the excitation tables while still eliminating the complex and costly body filters utilized in the prior art. Flanging and chorus effects, and virtual detuned strings are possible via the addition of nothing more than moving, interpolated taps, along the delay in the filtered delay loop, which sum together with the output.

What is claimed is:

1. A tone synthesis system for synthesizing a tone produced by a vibrating element in conjunction with a resonant member to which the vibrating element is acoustically coupled, comprising:

a closed loop including an input for receiving an excitation signal, a delay for delaying a signal circulating in the loop, and a filter for filtering a signal circulating in the loop and an output from the closed loop for providing a synthesized tone, wherein the amount of delay in the loop corresponds to the pitch of a tone to be synthesized;

excitation means for providing an excitation signal to the input, said excitation signal including components corresponding to a first partial response of said resonant member to an excitation of said vibrating element; and resonant filter means for imparting resonance to said output signal in accordance with a second partial response of said resonant member to the excitation of said vibrating element, wherein said first and second partial responses represent a total response of said resonant member to the excitation of said vibrating element.

2. A tone synthesis system as in claim 1 wherein the excitation means comprises at least one table storing values corresponding to said first partial response of said resonant member, and trigger means for reading table values to initiate production of a tone.

3. A tone synthesis system as in claim 2 wherein the total response of said resonance member includes a residual inverse-filter output signal and a long-ringing signal, the first partial response of said resonant member comprising the residual inverse-filter output signal of the total response of said resonant member.

4. A tone synthesis system as in claim 1, wherein the total response of said resonant member includes a residual output signal of an inverse filter and a long-ringing signal, the second partial response of said resonant member comprising the long-ringing signal of the total response of said resonant member.

5. A tone synthesis system as in claim 2 including plural tables storing values corresponding to at least one partial response and means for interpolating between plural table values based upon at least one performance parameter to provide the excitation signal.

6. A tone synthesis system as in claim 1 wherein the vibrating element is a string.

7. A tone synthesis system as in claim 1, wherein said excitation means comprises table means for storing data corresponding to said first partial response of said resonant member, and reading means for reading said stored data from said table means.

8. A tone synthesis system as in claim 7, wherein said reading means reads said stored data from said table means in response to an operation by a performer.

9. A tone synthesis system as in claim 1, wherein said excitation signal has a decaying oscillatory wave form.

10. A tone synthesis system as in claim 1, wherein said excitation signal has a duration longer than a period of said tone to be synthesized.

11. A tone synthesis system as in claim 1, wherein said excitation signal is based on a recording produced by exciting a physical object corresponding to said resonant member.

12. A tone synthesis system according to claim 11, wherein said excitation means comprises table means for storing data indicative of a plurality of excitation signals, wherein said stored data being obtained by exciting a plurality of physical objects corresponding to a plurality of resonant members, said excitation means further including reading means for reading from said table means stored data corresponding to a selected excitation signal.

13. A tone synthesis system according to claim 1, wherein said excitation means includes means for computing said excitation signal.

14. A tone synthesis system according to claim 13, wherein said computing means includes an inverse filter for filtering a desired tone, said inverse filter including filter coefficients determined based upon said vibrating element.

15. A tone synthesis system as in claim 1, further including:

separating means for separating said total excitation response into said first and second partial excitation responses.

16. A tone synthesis system according to claim 15, wherein said first partial excitation response includes a most-damped component of said total excitation response and wherein said second partial excitation response includes a least-damped component of said total excitation response.

17. A tone synthesis system as in claim 15, wherein said separating means includes means for measuring spectral peaks to determine said least-damped component.

18. A tone synthesis system as in claim 15, wherein said separating means includes weighting means for using a weighting function and a filter design algorithm to determine said least-damped component.

19. A tone synthesis system as in claim 1 wherein the resonant member is a guitar body.

20. A tone synthesis system as in claim 1 wherein the resonant member is a violin body.

21. A tone synthesis system as in claim 1 wherein the resonant member is a piano soundboard and enclosure.

22. A tone synthesis system as in claim 1, wherein the resonant member comprises a natural musical instrument.

23. A tone synthesis system as in claim 1, wherein at least one additional closed loop is coupled with said closed loop and excited in a manner similar to said closed loop, a composite output signal being provided to said resonant filter which contains components from each of said closed loops, where said closed loop and said at least one additional closed loop include delay amounts corresponding to different tunings.

24. A tone synthesis system as in claim 23, further including summing means for summing said output and an output from said at least one additional closed loop.

25. A tone synthesis system for synthesizing a tone signal produced by a vibrating element which excites a resonant system comprising:

a closed loop including an input for receiving an excitation signal, a delay for delaying a signal circulating in the loop, a filter for filtering a signal circulating in the loop and an output for providing a synthesized tone signal, wherein an amount of delay in the loop corresponds to the pitch of a tone to be synthesized;

excitation means for providing an excitation signal to the input, the excitation signal having a form corresponding to a partial response of the resonant system to an excitation of said vibrating element; and resonant filter means for imparting resonance to said output signal in accordance with a second partial response of said resonant system to said excitation of said vibrating element.

26. A tone synthesis system as in claim 25 wherein the excitation means comprises a table whose values are read out in response to a trigger signal.

27. A tone synthesis system as in claim 25 wherein the excitation signal has a decaying oscillatory form.

28. A tone synthesis system as in claim 26 wherein the excitation signal is a modified signal derived from a response of the resonant system to an excitation.

29. A tone synthesis system as in claim 26 wherein the table is read out repeatedly to provide a sustained tone.

30. A tone synthesis system as in claim 25 wherein the excitation signal has a form corresponding to a partial impulse response of the resonant system.

31. A tone synthesis system as in claim 30 wherein the excitation signal is comprised of a convolution of said partial impulse response and an arbitrary excitation function.

32. A tone synthesis system as in claim 25, wherein a convolution of said first and second partial responses represents a total response of said resonant system.

33. A tone synthesis system comprising:

a closed loop including an input for receiving an excitation signal, a delay for delaying a signal circulating in the loop, a filter for filtering a signal circulating in the loop and an output for providing a synthesized tone, wherein an amount of delay in the loop corresponds to the pitch of a tone to be synthesized;

means for providing an excitation signal having a first decaying oscillatory form; and means for imparting a resonance to said output having a second decaying oscillatory form which decays at a rate less than said first decaying oscillatory form.

34. A tone synthesis system as in claim 33 wherein the excitation means includes means for providing a basic excitation signal, means for delaying the basic excitation signal by a predetermined amount, and means for summing the basic excitation signal and delayed basic excitation signal and providing the sum to the closed loop.

35. A tone synthesis system as in claim 33 further including a second excitation means for providing a second excitation signal in parallel with the excitation signal and means for summing the excitation signal and second excitation signal to provide a resultant excitation signal to the closed loop.

36. A tone synthesis system as in claim 33 further including second excitation means for providing a second excitation signal in parallel with the excitation signal and means for interpolating between the parallel signals to provide an interpolated excitation signal to the closed loop.

37. A tone synthesis system as in claim 36 wherein the means for interpolating includes means for variably interpolating between the parallel signals in response to a control signal, and means for providing the control signal.

38. A tone synthesis system as in claim 34 wherein the closed loop corresponds to a plucked string and wherein the predetermined amount of delay represents a position at which the string is plucked.

39. A tone synthesis system as in claim 33, further including a second closed loop for circulating an excitation signal and providing a second output signal, and means for summing said output of said closed loop with said second output signal to produce a combined output signal.

40. A tone synthesis system as in claim 33, wherein said resonance imparting means includes means for producing a plurality of output signals, said synthesis system including means for summing each of said plurality of output signals.

41. A tone synthesis system as in claim 33, said closed loop including a moving delay-line tap for extracting a second output from said closed loop which is delayed a variable amount with respect to said output.

42. A tone synthesis system as in claim 33, said closed loop including a fixed delay-line tap for extracting a second output from said closed loop which is delayed with respect to said output.

43. A tone synthesis system as in claim 39, further including a coupling filter for filtering said combined output signal, said coupling filter producing a feedback signal which is supplied to at least one of said closed loops.

44. A tone synthesis system comprising:

a closed loop including an input for receiving an excitation signal, a delay for delaying a signal circulating in the loop, a filter for filtering a signal circulating in the loop and an output for providing a signal from the loop as a synthesized tone;

excitation means for providing an excitation signal, having a form corresponding to a partial response of a resonant system to an excitation, to the input of the closed loop in response to a trigger signal, the excitation means including plural excitation tables each storing a different excitation signal and means for mixing the outputs of the excitation tables to provide a composite excitation signal.

45. A tone synthesis system as in claim 44 wherein the means for mixing includes means for varying respective amounts of the outputs of the excitation tables in accordance with a plurality of respective weighting factors.

46. A tone synthesis system as in claim 45, further including means for varying said weighting factors over time.

* * * * *